US009244384B2

(12) United States Patent
Nakamura et al.

(10) Patent No.: US 9,244,384 B2
(45) **Date of Patent: *Jan. 26, 2016**

(54) DEVELOPER CONTAINER AND IMAGE FORMING APPARATUS INCLUDING THE SAME

(71) Applicant: KYOCERA Document Solutions Inc., Osaka-shi, Osaka (JP)

(72) Inventors: Arata Nakamura, Osaka (JP); Daisuke Eto, Osaka (JP); Hirohito Konishi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/580,599

(22) Filed: Dec. 23, 2014

(65) Prior Publication Data

US 2015/0185663 A1 Jul. 2, 2015

(30) Foreign Application Priority Data

Dec. 27, 2013 (JP) ..... 2013-270623
Dec. 27, 2013 (JP) ..... 2013-270624

(51) Int. Cl.
*G03G 15/08* (2006.01)

(52) U.S. Cl.
CPC ..... *G03G 15/0877* (2013.01); *G03G 15/0875* (2013.01); *G03G 15/0893* (2013.01)

(58) Field of Classification Search
CPC ..... G03G 15/0865; G03G 15/0886; G03G 15/0836; G03G 15/0839; G03G 15/087; G03G 15/0877
See application file for complete search history.

(56) References Cited

U.S. PATENT DOCUMENTS 8,918,032 B2 * 12/2014 Abler et al. ..... 399/262
8,923,734 B2 * 12/2014 Abler et al. ..... 399/262

(Continued)

FOREIGN PATENT DOCUMENTS

JP 2003-280344 10/2003
JP 2009-265395 11/2009

OTHER PUBLICATIONS

Abstract of reference Eto et al. (JP 5,564,612 B1); Pub date Jul. 30, 2014.*

(Continued)

*Primary Examiner* — Rodney Bonnette
(74) *Attorney, Agent, or Firm* — Gerald E. Hespos; Michael J. Porco; Matthew T. Hespos

(57) ABSTRACT

A developer container includes a container body, a lid, a developer discharge port, a shaft, and a movable wall. The container body includes an inner surface defining a cylindrical internal space and a wall disposed at one end of the container body. The container body is formed with the developer discharge port. The lid is attached to the other end of the container body. The shaft includes a first engaging portion. The movable wall includes a conveying surface and a carrier bearing. The conveying surface defines a storage space configured to contain the developer. The carrier bearing includes a second engaging portion. The movable wall is movable along the shaft in the first direction while conveying the developer by engagement of the first engaging portion and the second engaging portion. The first engaging portion includes a small pitch part having a relatively small thread pitch.

15 Claims, 20 Drawing Sheets

(56) References Cited

U.S. PATENT DOCUMENTS

| | | | | |
|---|---|---|---|---|
| 9,063,460 | B2 * | 6/2015 | Abler et al. | |
| 2009/0269112 | A1 | 10/2009 | Fukunaga et al. | |
| 2015/0185659 | A1 * | 7/2015 | Konishi et al. | 399/262 |
| 2015/0185661 | A1 * | 7/2015 | Eto | 399/262 |

OTHER PUBLICATIONS

Drawings of reference Eto et al. (JP 5,564,612 B1); Pub date Jul. 30, 2014.*

* cited by examiner

BACKWARD
FORWARD
LEFT
RIGHT
30
392
391
38
39
316
314
313
31
312
317
31T
318
315

TOP
BOTTOM
LEFT
RIGHT
30
392
39
38
37
316
311
31
312
317
31T
319
318
50
M

TOP
BOTTOM
FORWARD
BACKWARD
30
392
391
38
37
39
311
40

TOP
BACKWARD
LEFT
RIGHT
FORWARD
BOTTOM
34
34K
341A
340
342
341
344
341B
340C
34J
340D

TOP
FORWARD
LEFT
RIGHT
BACKWARD
BOTTOM
34
34K
340B
344
34J
342
342A
342B
343
340S
341
341A
340B
344
340
340A

DEVELOPER CONTAINER AND IMAGE FORMING APPARATUS INCLUDING THE SAME

INCORPORATION BY REFERENCE

This application is based on Japanese Patent Applications No. 2013-270623 and No. 2013-270624 filed with the Japan Patent Office on Dec. 27, 2013, the contents of which are hereby incorporated by reference.

BACKGROUND

The present disclosure relates to a developer container configured to contain developer and an image forming apparatus including the same.

Conventionally, the following container is known as an example of developer containers for containing toner (developer). The toner container includes a toner discharge port and a rotary stirring member. Toner is discharged through the toner discharge port by rotation of the stirring member.

SUMMARY

A developer container according to an aspect of the present disclosure includes a container body, a lid, a developer discharge port, a shaft, a driving transmitter, and a movable wall. The container body includes an inner surface defining a cylindrical internal space extending in a first direction, and a wall disposed at one end of the container body in the first direction and defining an end surface of the internal space. The container body is formed with the developer discharge port formed in a lower portion of the container body and communicating with the internal space for discharging developer therethrough. The lid is attached to the other end of the container body that is opposite to the wall in the first direction for closing the internal space. The shaft includes a first engaging portion having a helical thread formed on an outer surface thereof, the shaft extending in the first direction in the internal space and rotatably supported on the wall and the lid. The driving transmitter transmits a rotational driving force to the shaft. The movable wall includes an outer surface, a conveying surface, and a carrier bearing. The outer surface is disposed in close contact with the inner surface of the container body. The conveying surface defines a storage space configured to contain the developer in cooperation with the inner surface of the container body. The carrier bearing includes a second engaging portion protruding from an inner surface of the carrier bearing, the carrier bearing allowing the shaft to pass therethrough. The movable wall moves along the shaft in the first direction in the internal space from an initial position remote from the developer discharge port to a predetermined position closer to the developer discharge port while conveying the developer in the storage space to the developer discharge port by engagement of the first engaging portion and the second engaging portion. The first engaging portion includes a small pitch part having a relatively small thread pitch in the first direction.

An image forming apparatus according to another aspect of the present disclosure includes an apparatus body, the above-described developer container, an image carrier, a developing device, and a transfer section. The developer container is detachably mounted in the apparatus body. The image carrier has a surface configured to allow an electrostatic latent image to be formed thereon and operable to carry a developed image. The developing device receives the developer supplied from the developer container and supplies the developer to the image carrier. The transfer section transfers the developed image from the image carrier onto a sheet.

These and other objects, features and advantages of the present disclosure will become more apparent upon reading the following detailed description along with the accompanying drawings.

DETAILED DESCRIPTION

Figure 1:
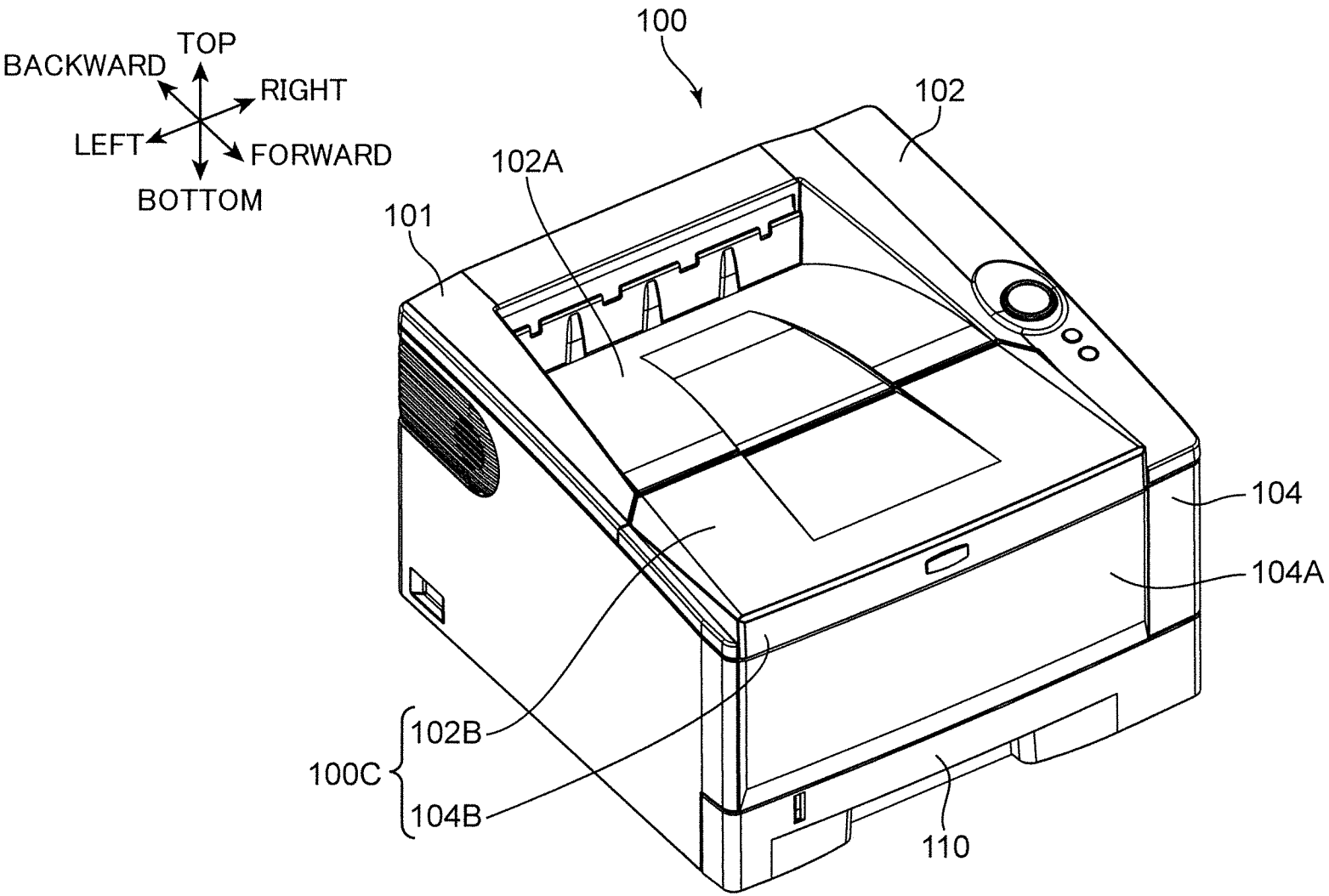
FIG. 1 is a perspective view of an image forming apparatus according to an embodiment of the present disclosure.
Figure 2:
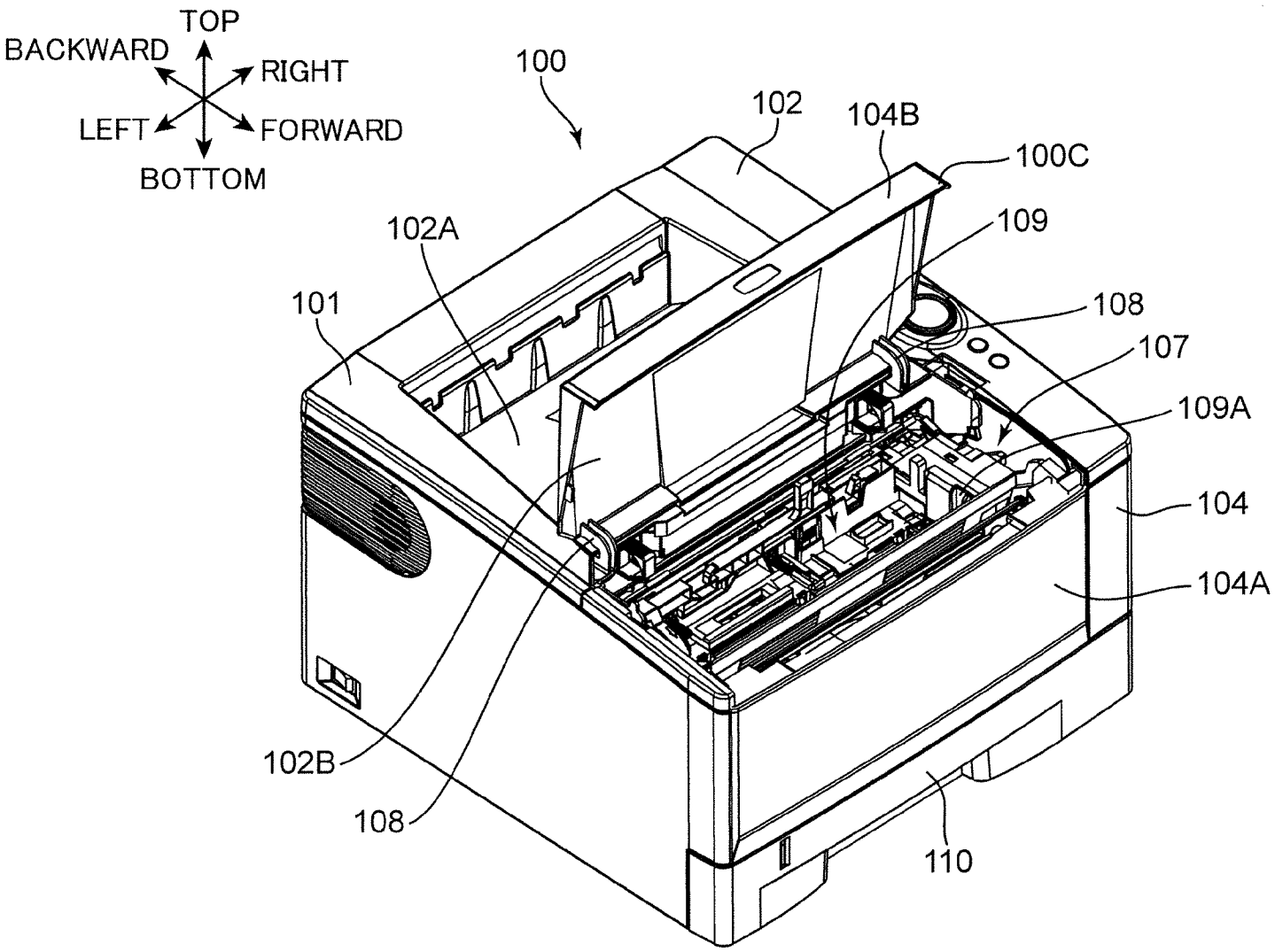
FIG. 2 is a perspective view of the image forming apparatus according to the embodiment of the present disclosure, a part of the apparatus being opened.
Figure 3:
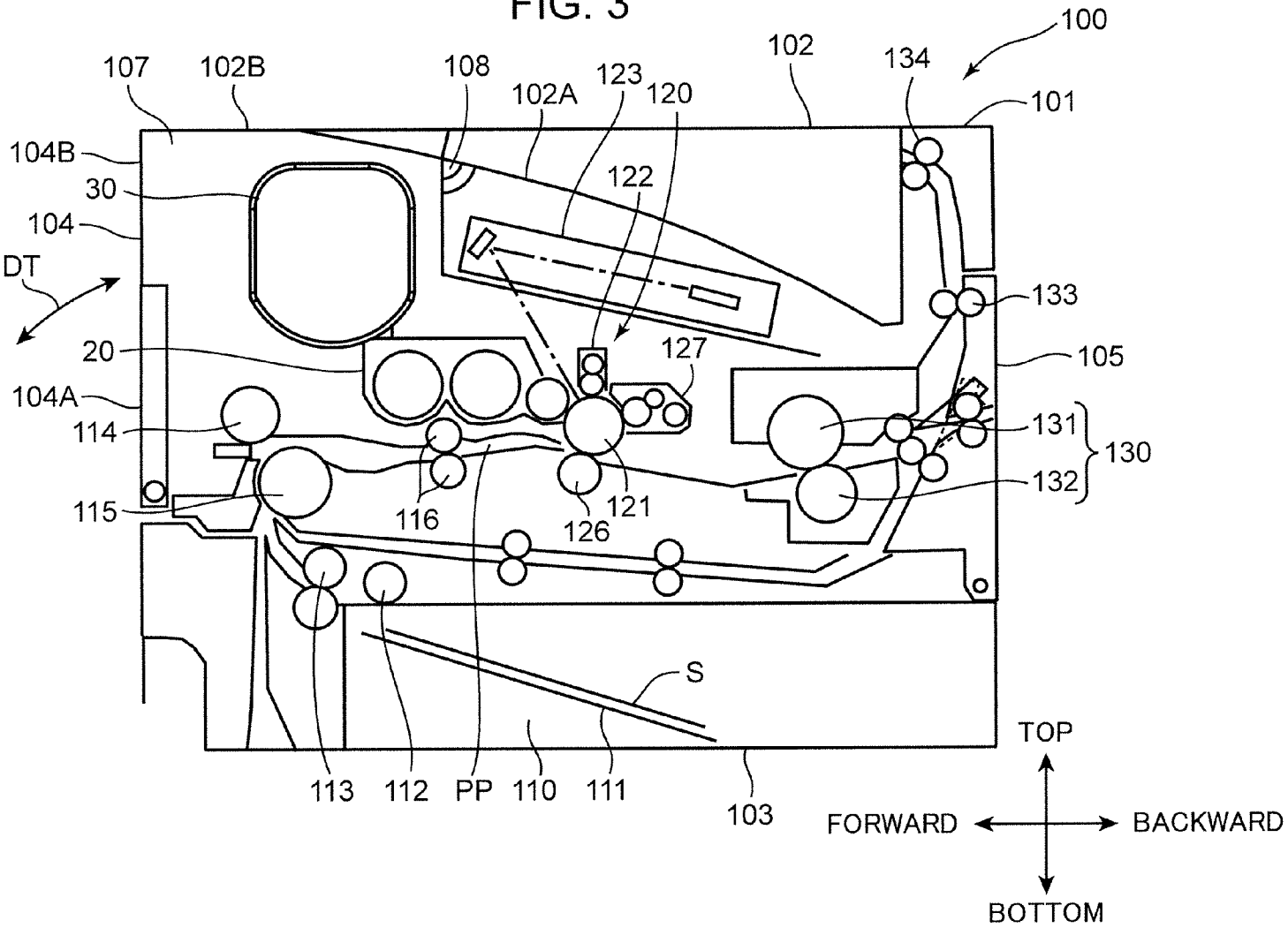
FIG. 3 is a schematic sectional view showing an internal structure of the image forming apparatus according to the embodiment of the present disclosure.

Hereinafter, an embodiment of the present disclosure will be described with reference to the accompanying drawings. FIG. 1 and FIG. 2 are perspective views of a printer 100 (image forming apparatus) according to an embodiment of the present disclosure. FIG. 3 is a schematic sectional view showing an internal structure of the printer 100 shown in FIGS. 1 and 2. The printer 100 shown in FIGS. 1 to 3, which exemplifies the image forming apparatus, is a so-called monochrome printer. However, other apparatuses may alternatively be provided as an image forming apparatus in other embodiments, such as a color printer, a facsimile apparatus or a multifunctional apparatus equipped with these functions, or another type of apparatus for forming a toner image on a sheet. It should be noted that hereinafter, terms indicating directions such as "top" "bottom" "forward" "backward" "left" and "right" are intended merely for a descriptive purpose, and not for limiting the principle of the image forming apparatus.

The printer 100 includes a housing 101 (apparatus body) for housing various components that are used for forming an image on a sheet S. The housing 101 includes a top wall 102 defining the top surface of the housing 101, a bottom wall 103 (FIG. 3) defining the bottom surface of the housing 101, a main body rear wall 105 (FIG. 3) connecting the top wall 102 and the bottom wall 103, and a main body front wall 104 located in front of the main body rear wall 105. The housing 101 includes a main body internal space 107 where various components are placed. A sheet conveyance passage PP extends in the main body internal space 107 of the housing 101, the sheet conveyance passage PP for allowing passage of a sheet S in a given conveying direction. Further, the printer 100 includes an opening/closing cover 100C mounted on the housing 101 in an openable and closable manner.

The opening/closing cover 100C includes a front wall upper portion 104B constituting an upper portion of the main body front wall 104, and a top wall front portion 102B constituting a front portion of the top wall 102. The opening/closing cover 100C is vertically openable and closable with unillustrated hinge shafts acting as a fulcrum, the hinge shafts being respectively disposed on a pair of arms 108 disposed at lateral opposite ends of the opening/closing cover 100C (FIG. 2). When the opening/closing cover 100C is open, the main body internal space 107 is exposed to the outside at the top thereof. On the other hand, when the opening/closing cover 100C is closed, the main body internal space 107 is closed at the top thereof.

A sheet discharge section 102A is disposed in a central part of the top wall 102. The sheet discharge section 102A includes an oblique surface sloping downward from a front end to a rear end of the top wall 102. A sheet S that has been subjected to image formation in an image forming section 120 described later is discharged onto the sheet discharge section 102A. Further, a manual feed tray 104A is disposed in a vertically central part of the main body front wall 104. The manual feed tray 104A is vertically rotatable with a lower end thereof acting as a fulcrum (in the direction of an arrow DT in FIG. 3).

With reference to FIG. 3, the printer 100 includes a cassette 110, a pickup roller 112, a first sheet feeding roller 113, a second sheet feeding roller 114, a conveying roller 115, a pair of registration rollers 116, the image forming section 120, and a fixing device 130.

The cassette 110 stores sheets S therein. The cassette 110 includes a lift plate 111. The lift plate 111 is tilted to lift a leading edge of a sheet S. The cassette 110 can be pulled out forwardly with respect to the housing 101.

The pickup roller 112 is disposed above a leading edge of a sheet S lifted by the lift plate 111. The pickup roller 112 rotates to draw the sheet S from the cassette 110.

The first sheet feeding roller 113 is disposed downstream of the pickup roller 112 and conveys a sheet S further downstream. The second sheet feeding roller 114 is disposed at the inner side (rear side) of the fulcrum of the manual feed tray 104A and draws a sheet placed on the manual feed tray 104A into the housing 101.

The conveying roller 115 is disposed downstream of the first sheet feeding roller 113 and the second sheet feeding roller 114 in their sheet conveying direction (hereinafter, the sheet conveying direction also being referred to simply as "conveying direction", and the downstream in the sheet conveying direction also being referred to simply as "downstream"). The conveying roller 115 conveys a sheet fed by the first sheet feeding roller 113 or the second sheet feeding roller 114 further downstream.

The pair of registration rollers 116 functions to correct the angle of a sheet S that has been obliquely conveyed. This makes it possible to adjust the position of an image to be formed on the sheet S. The pair of registration rollers 116 supplies the sheet S to the image forming section 120 in accordance with a timing of image formation to be performed by the image forming section 120.

The image forming section 120 includes a photoconductive drum 121 (image carrier), a charger 122, an exposure device 123, a developing device 20, a toner container 30 (developer container), a transferring roller 126 (transferring section), and a cleaning device 127.

The photoconductive drum 121 is in the form of a cylinder. The photoconductive drum 121 has a circumferential surface to be formed with an electrostatic latent image and operable to carry a toner image (developed image) corresponding to the electrostatic latent image. The charger 122 is applied with a predetermined voltage, and charges the circumferential surface of the photoconductive drum 121 substantially uniformly.

The exposure device 123 irradiates the circumferential surface of the photoconductive drum 121 charged by the charger 122 with laser light. The laser light is emitted in accordance with image data output from an external device such as personal computer (not shown) which is communicably connected to the printer 100. Consequently, the circumferential surface of the photoconductive drum 121 is formed with an electrostatic latent image corresponding to the image data.

The developing device 20 supplies toner to the circumferential surface of the photoconductive drum 121, the circumferential surface being formed with an electrostatic latent image. The toner container 30 supplies toner to the developing device 20. The toner container 30 is detachably attached to the developing device 20. When the developing device 20 has supplied toner to the photoconductive drum 121, the electrostatic latent image formed on the circumferential surface of the photoconductive drum 121 is developed (visualized). Consequently, the circumferential surface of the photoconductive drum 121 is formed with a toner image (developed image).

The transferring roller 126 is disposed below and opposite to the photoconductive drum 121 across the sheet conveyance passage PP. The transferring roller 126 defines a transfer nip in cooperation with the photoconductive drum 121 for transferring a toner image onto a sheet S.

The cleaning device 127 removes, after a toner image is transferred onto a sheet S from the circumferential surface of the photoconductive drum 121, toner remaining on the circumferential surface.

The fixing device 130 is disposed downstream of the image forming section 120 in the conveying direction, and fixes a toner image on a sheet S. The fixing device 130 includes a heating roller 131 for melting toner on a sheet S, and a pressure roller 132 for bringing the sheet S into close contact with the heating roller 131.

The printer 100 further includes a pair of conveying rollers 133 disposed downstream of the fixing device 130, and a pair of discharge rollers disposed downstream of the pair of conveying rollers 133. A sheet S is conveyed upward by the pair of conveying rollers 133 to be finally discharged from the housing 101 by the pair of discharge rollers 134. The sheet S discharged from the housing 101 is placed on the sheet discharge section 102A, thereby resulting in a stack of sheets.

<Developing Device>

Figure 4:
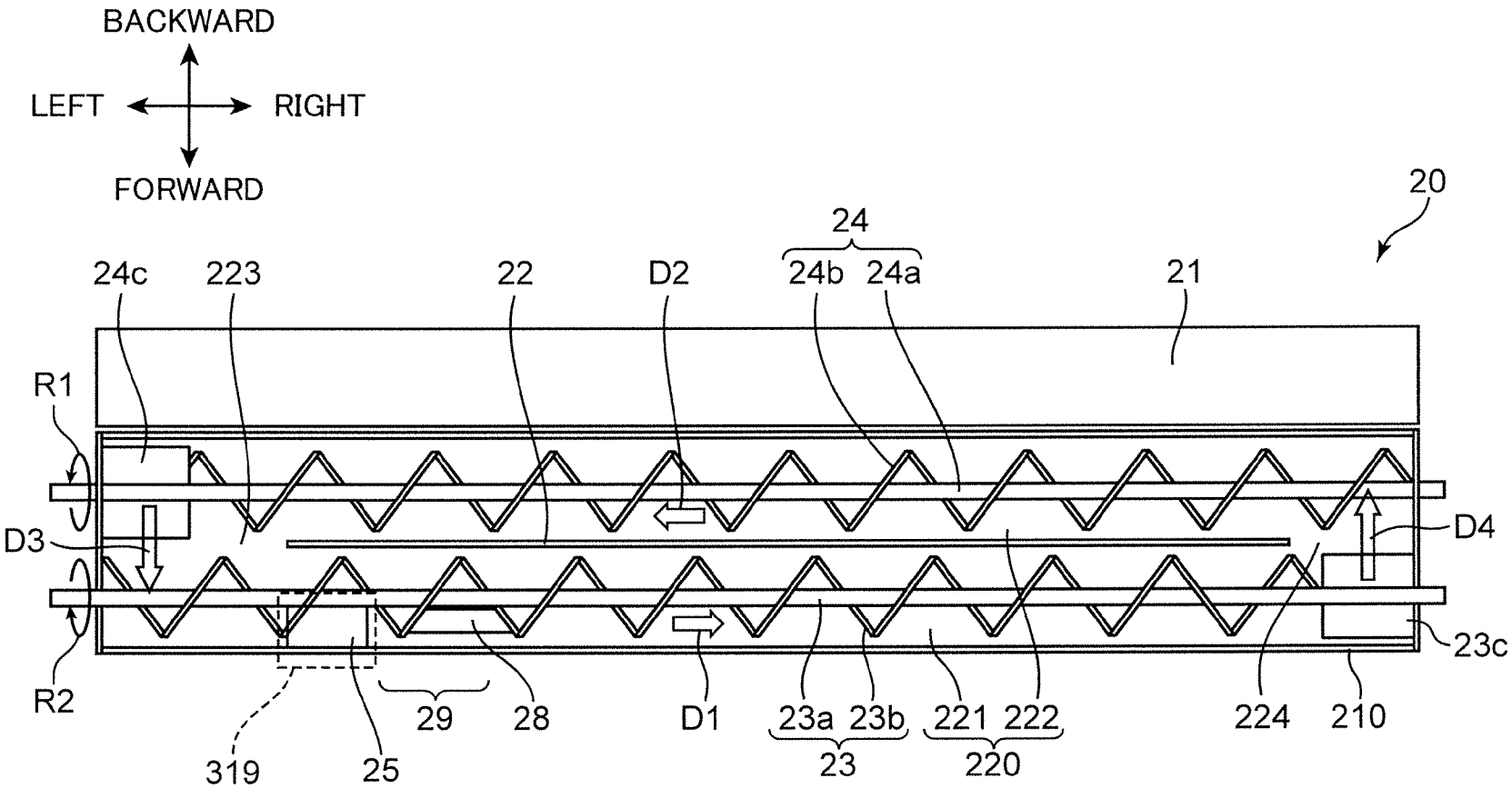
FIG. 4 is a schematic plan view showing an internal structure of a developing device according to the embodiment of the present disclosure

FIG. 4 is a plan view showing an internal structure of the developing device 20. The developing device 20 includes a development housing 210 in the form of a box having a longer dimension in a specific direction (an axial direction of a developing roller 21 or a left-right direction). The development housing 210 includes a storage space 220. In the storage space 220, there are disposed the developing roller 21, a first stirring screw 23, a second stirring screw 24 and a toner supply port 25. The present embodiment employs a one-component developing method and, therefore, the storage space 220 is filled with toner that is to be used as developer. On the other hand, in the case of a two-component developing method, a mixture of toner and carrier consisting of a magnetic material is filled as developer. The toner is circulatively conveyed in the storage space 220 and successively supplied from the developing roller 21 to the photoconductive drum 121 in order to develop an electrostatic latent image.

The developing roller 21 is in the form of a cylinder extending in the longitudinal direction of the development housing 210, and includes a sleeve constituting the circumference of the developing roller 21 and operable to be rotationally driven.

The storage space 220 of the development housing 210 is covered by an unillustrated top portion, and divided into a first conveyance passage 221 and a second conveyance passage 222 which have a longer dimension in the left-right direction, by a partition plate 22 extending in the left-right direction. The partition plate 22 is shorter than the lateral width of the development housing 210 to define a first communication passage 223 and a second communication passage 224 respectively at the left and right sides of the partition plate 22, the first and second communication passages 223 and 224 allowing communication between the first conveyance passage 221 and the second conveyance passage 222. Consequently, there is a circulation passage constituted by the first conveyance passage 221, the second communication passage 224, the second conveyance passage 222, and the first communication passage 223 in the storage space 220. Toner is conveyed through the circulation passage counterclockwise in FIG. 4.

The toner supply port 25 (developer receiving port) is an opening formed in the top portion, and is disposed near an upper left end of the first conveyance passage 221. The toner supply port 25 faces the above-mentioned circulation passage, and functions to allow replenishment toner (replenishment developer) supplied from the toner container 30 to flow into the storage space 220.

The first stirring screw 23 is disposed in the first conveyance passage 221. The first stirring screw 23 includes a first rotary shaft 23*a*, and a first spiral blade 23*b* (screw blade) in the form of a spiral protrusion formed on the circumferential surface of the first rotary shaft 23*a*. The first stirring screw 23 is driven to rotate around the axis of the first rotary shaft 23*a* (in the direction of an arrow R2) to convey toner in the direction of an arrow D1 shown in FIG. 4. The first stirring screw 23 conveys toner so that the toner passes through a position between the toner supply port 25 and the first conveyance passage 221. Therefore, the first stirring screw 23 functions to convey toner that has been conveyed from the second conveyance passage 222 into the first conveyance passage 221 while mixing it with new toner flowing in from the toner supply port 25. A first paddle 23*c* is disposed in a downstream part of the first stirring screw 23 in the toner conveying direction (in the arrow D1 direction). The first paddle 23*c* is in the form of a plate-shaped member disposed on the first rotary shaft 23*a*. The first paddle 23*c* is rotated with the first rotary shaft 23*a* to deliver toner from the first conveyance passage 221 to the second conveyance passage 222 in the direction of an arrow D4 shown in FIG. 4.

The second stirring screw 24 is disposed in the second conveyance passage 222. The second stirring screw 24 includes a second rotary shaft 24*a*, and a second spiral blade 24*b* in the form of a spiral protrusion formed on the circumferential surface of the second rotary shaft 24*a*. The second stirring screw 24 is driven to rotate around the axis of the second rotary shaft 24*a* (in the direction of an arrow R1) to supply toner to the developing roller 21 while conveying it in the direction of an arrow D2 shown in FIG. 4. A second paddle 24*c* is disposed in a downstream part of the second stirring screw 24 in the toner conveying direction (in the arrow D2 direction). The second paddle 24 is rotated with the second rotary shaft 24*a* to deliver toner from the second conveyance passage 222 to the first conveyance passage 221 in the direction of an arrow D3 shown in FIG. 4.

The toner container 30 (FIG. 3) is disposed above the toner supply port 25 of the development housing 210. The toner container 30 includes a toner discharge port 319 (FIG. 4). The toner discharge port 319 is disposed at a bottom portion 311 (FIG. 6) of the toner container 30 and corresponds to the toner supply port 25 of the development housing 20. Toner falling through the toner discharge port 319 passes through the toner supply port 25 to be supplied to the development device 20.

<Supply of Toner>

Figure 5:
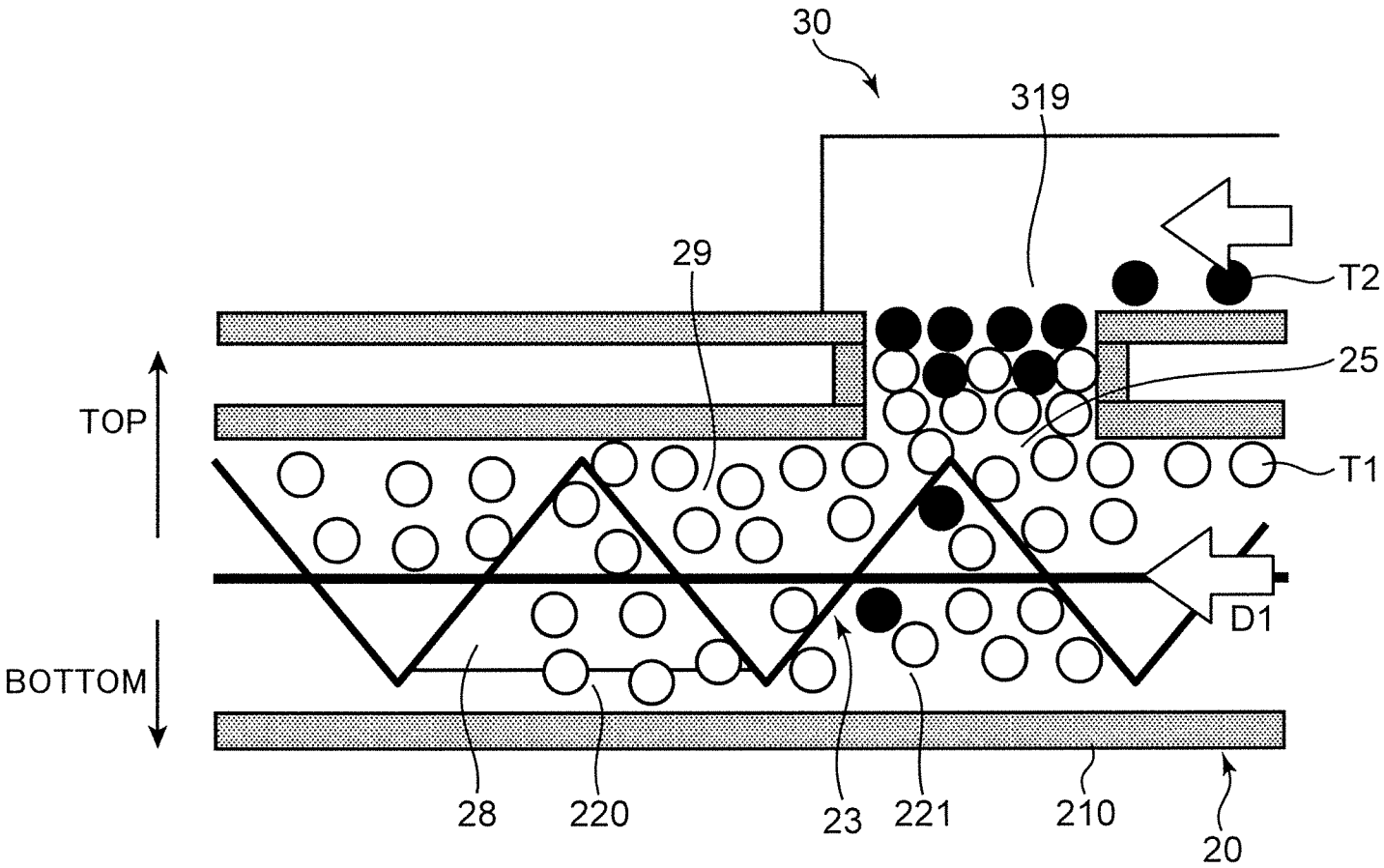
FIG. 5 is schematic sectional view illustrating supply of developer to the developing device according to the embodiment of the present disclosure.

Now, there will be described a flow of toner that is newly supplied through the toner supply port 25. FIG. 5 is a sectional view of the vicinity of the toner supply port 25 disposed in the developing device 20 and the toner discharge port 319 disposed in the toner container 30.

Replenishment toner T2 that is supplied through the toner discharge port 319 of the toner container 30 falls into the first conveyance passage 221 to be mixed with existing toner T1, and the mixture of toners T1 and T2 are conveyed in the arrow D1 direction by the first stirring screw 23. At this time, the toners T1 and T2 are stirred and charged.

The first stirring screw 23 includes a reducing paddle 28 (conveying ability reducing portion) disposed downstream of the toner supply port 25 in the toner conveying direction, the reducing paddle for partially reducing the ability of conveying toner. In the present embodiment, the reducing paddle 28 is in the form of a plate-like member disposed between a particular advancing point and a particular receding point of a turn of the first spiral blade 23*b*. The reducing paddle 28 rotates with the first rotary shaft 23*a* to cause toner that is being conveyed from the upstream side of the reducing paddle 28 to begin to accumulate. The accumulation of toner grows up to an immediate upstream of the reducing paddle 28, that is, a portion where the toner supply port 25 faces the first conveyance passage 221. As a result, a tonner accumulation portion 29 (developer accumulation portion) appears near the inlet of the toner supply port 25.

When the amount of toner in the storage space 220 has increased due to the supply of replenishment toner T2 though the toner supply port 25, the toner of the accumulation portion 29 covers (seals) the toner supply port 25, consequently preventing further toner supply. Thereafter, as the toner of the accumulation portion 29 decreases in amount because of consumption of toner in the storage space 220 by the developing roller 21, the amount of toner covering the toner supply port 25 decreases such that a gap appears between the accumulation portion 29 and the toner supply port 25. This allows new inflow of replenishment toner T2 into the storage space 220 through the toner supply port 25. In this manner, the present embodiment employs the volume replenishment type toner supply method in which the amount of replenishment toner to be received is adjusted in accordance with a decrease in the amount of toner of the accumulation portion 29.

<Structure of Toner Container>

Figure 6:
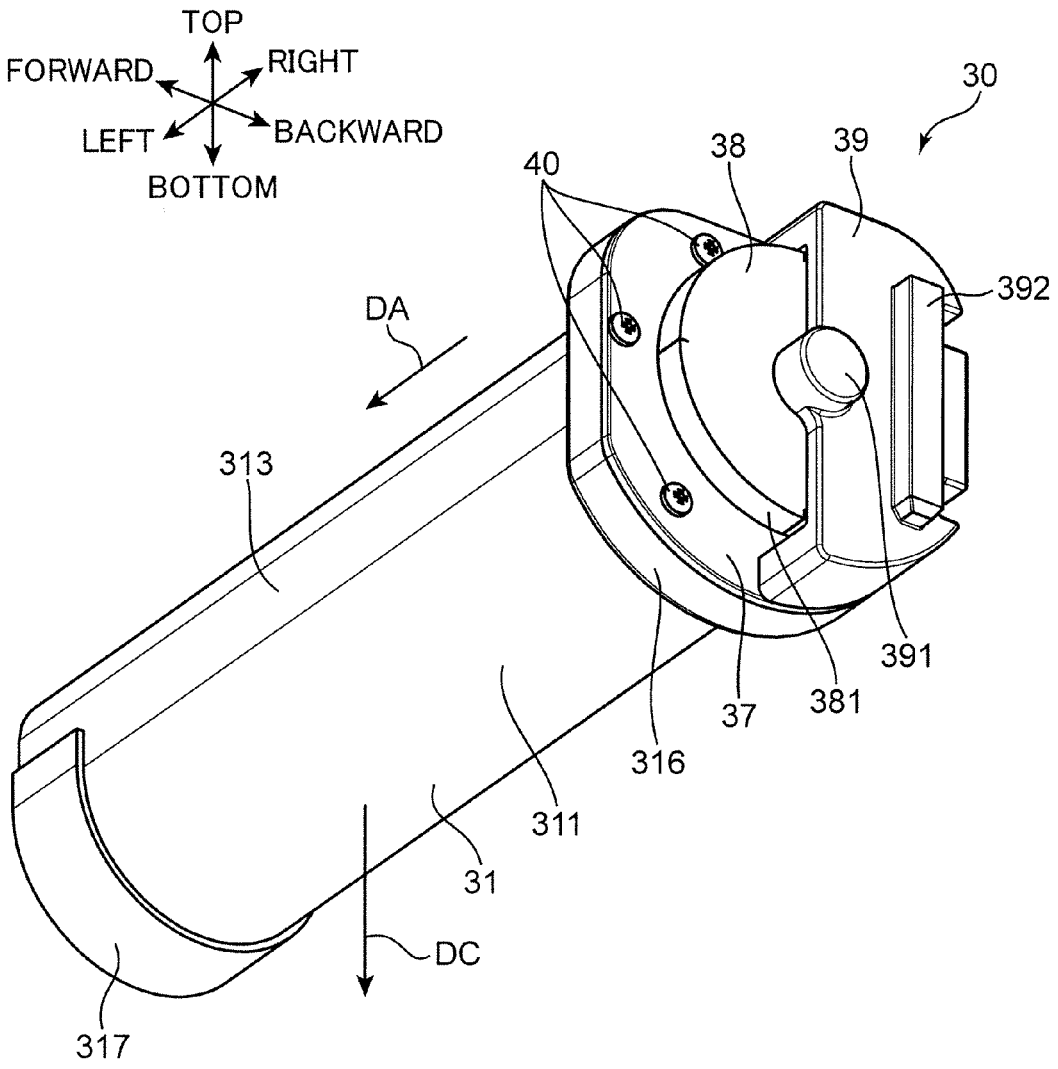
FIG. 6 is a perspective view of a developer container according to a first embodiment of the present disclosure.
Figure 7:
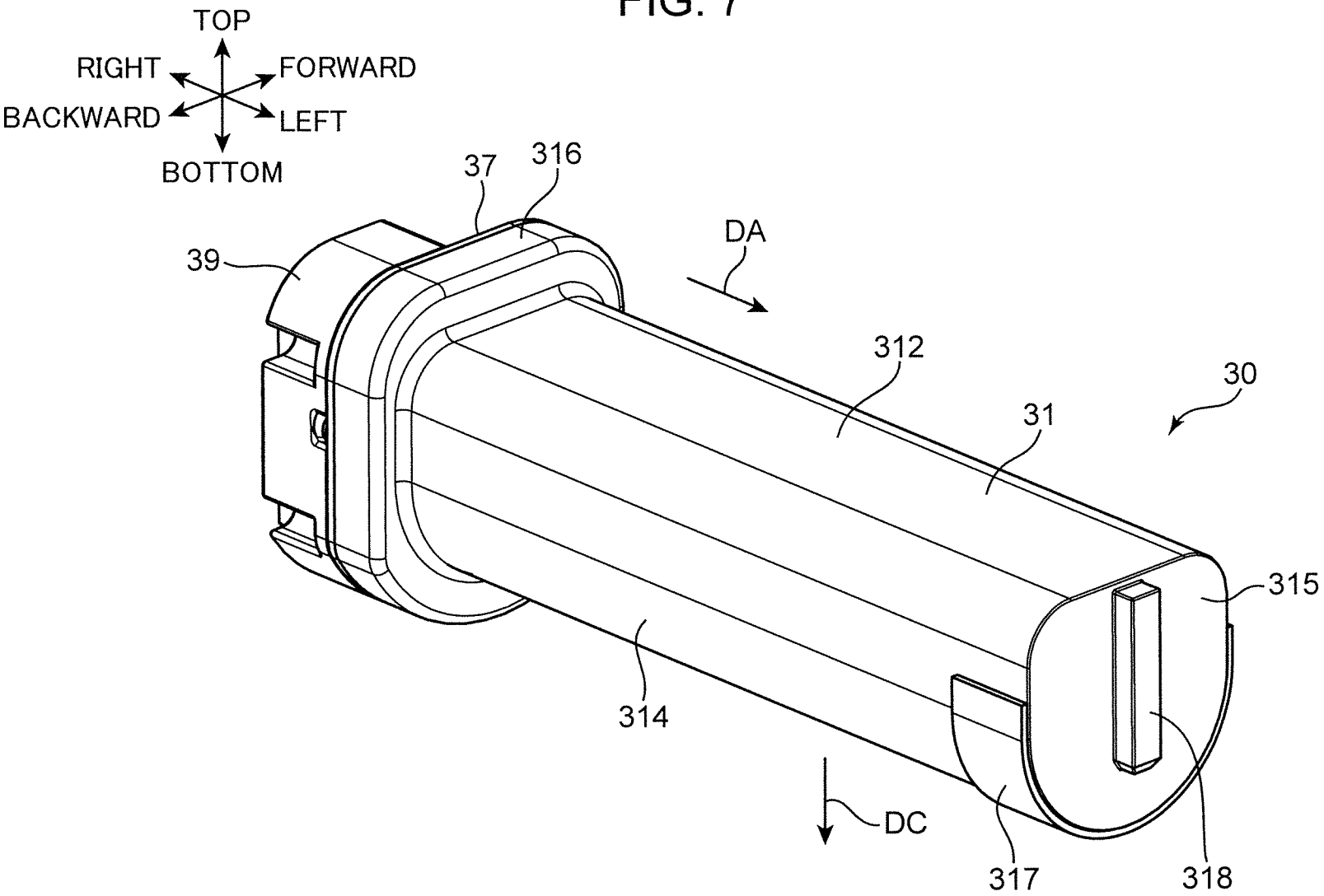
FIG. 7 is a perspective view of the developer container according to the first embodiment of the present disclosure.
Figures 8A, 8B, 8C:
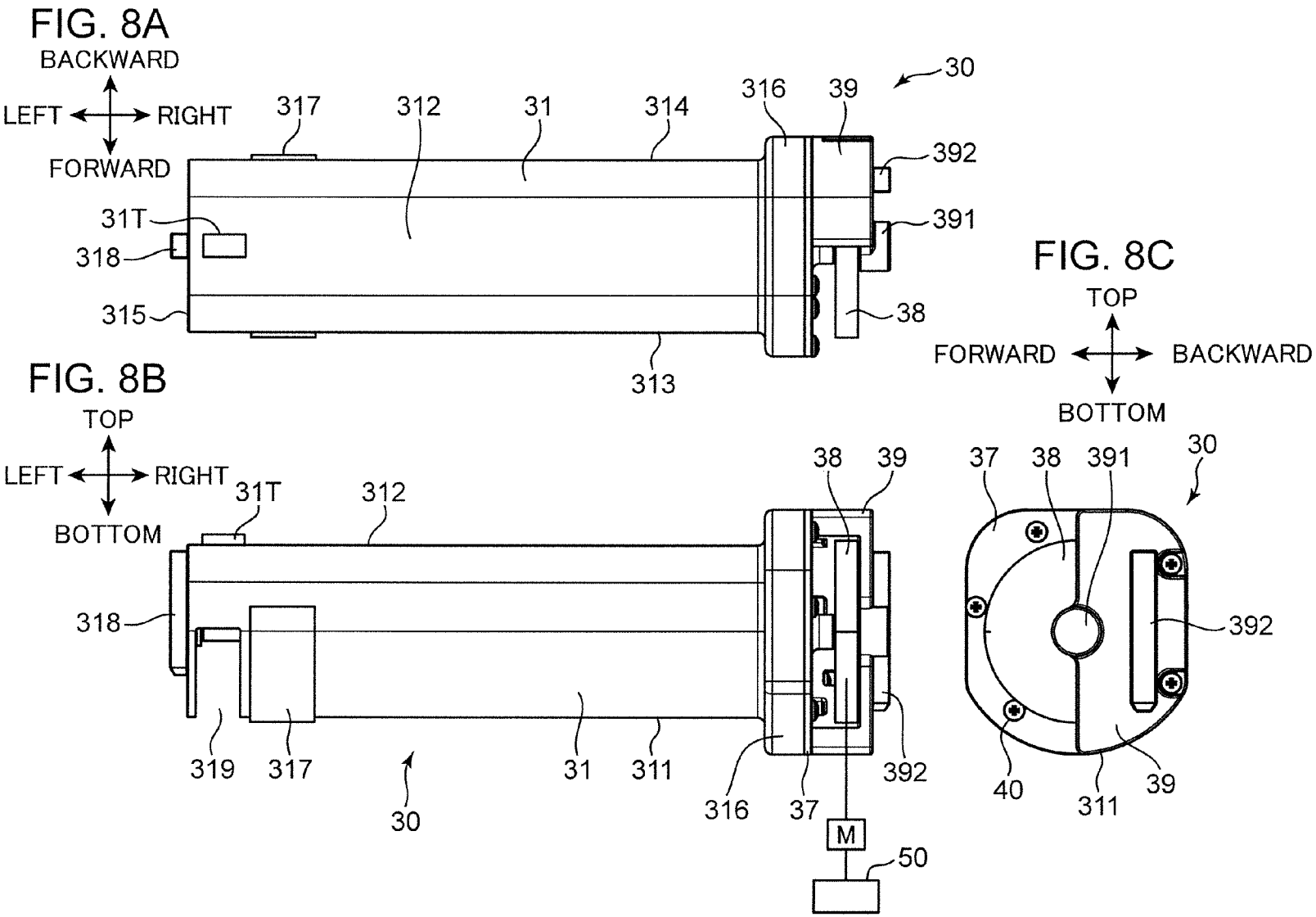
FIG. 8A is a plan view of the developer container according to the first embodiment of the present disclosure, FIG. 8B being a front view of the container, and FIG. 8C being a side view of the container.
Figure 9:
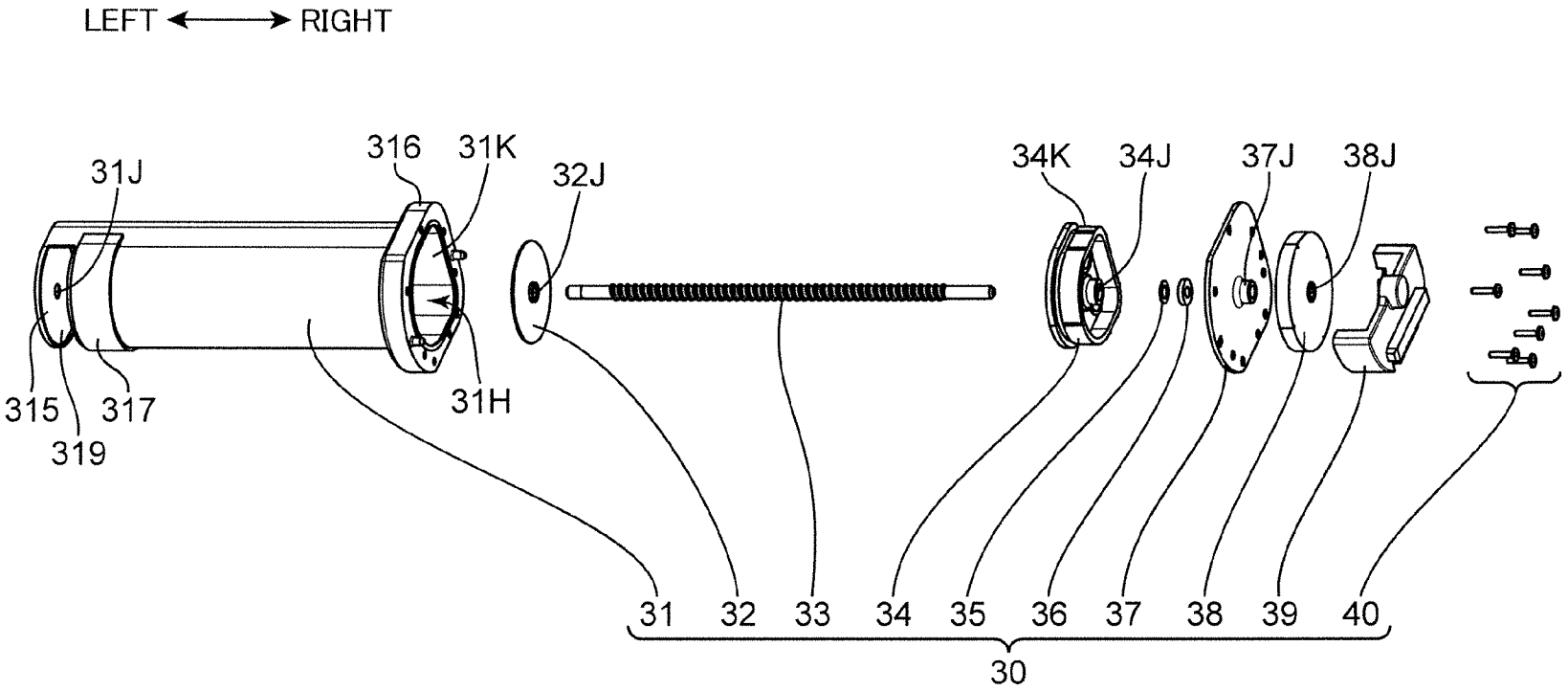
FIG. 9 is an exploded perspective view of the developer container according to the first embodiment of the present disclosure.
Figures 10A, 10B:
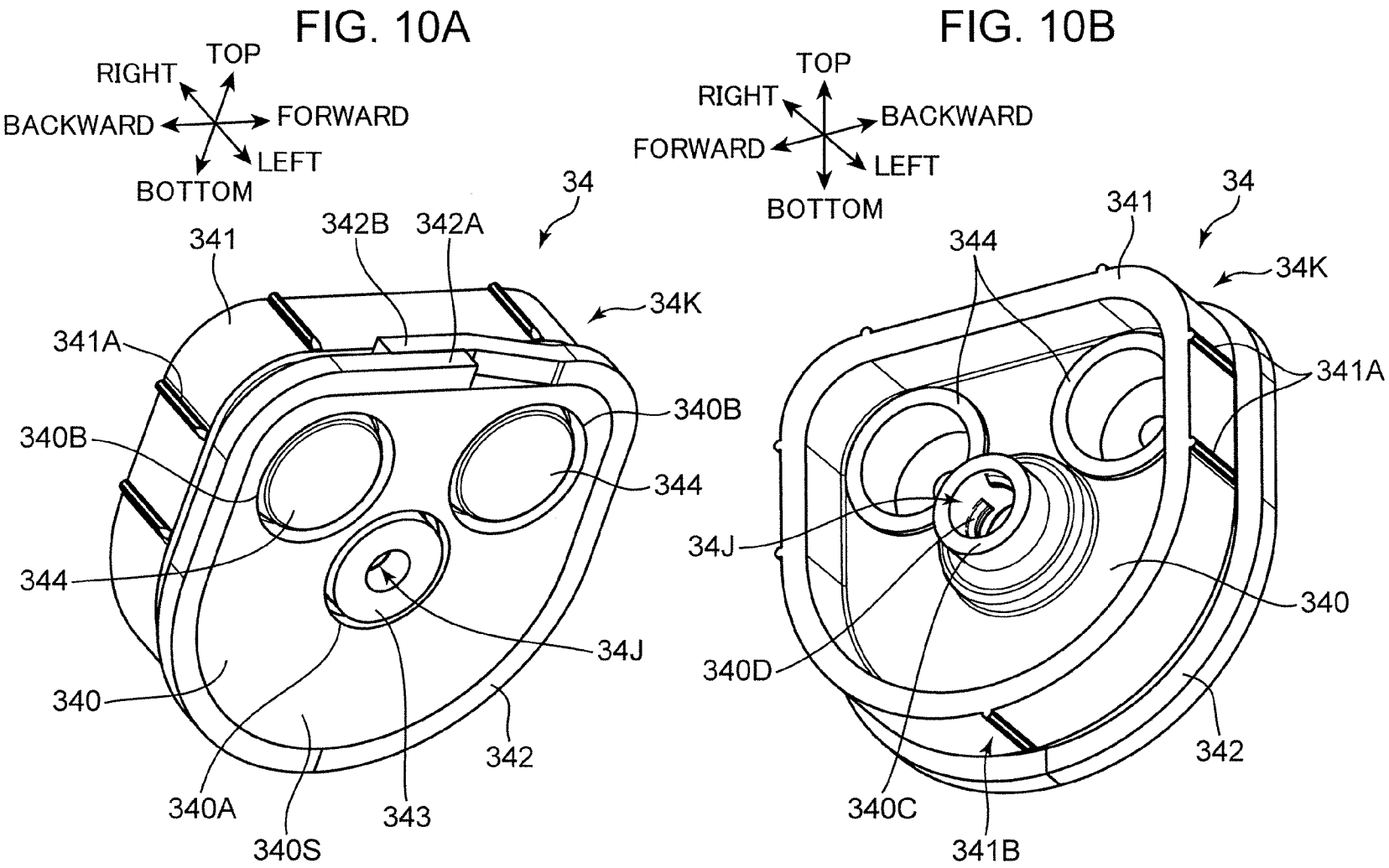
FIG. 10A and FIG. 10B are perspective views of a movable wall of the developer container according to the first embodiment of the present disclosure.
Figure 11:
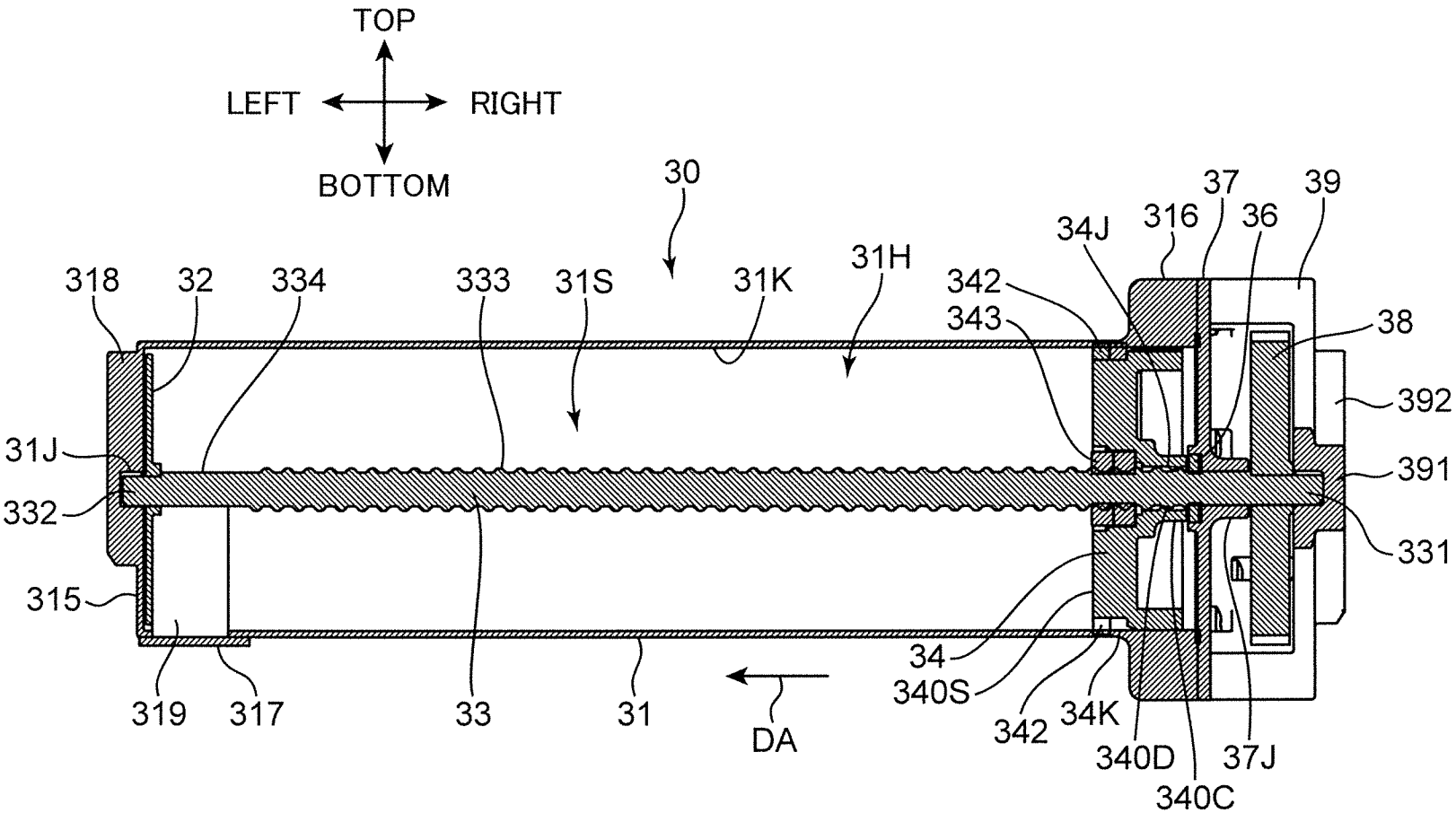
FIG. 11 is a sectional view of the developer container according to the first embodiment of the present disclosure.

Now there will be described the toner container 30 (developer container) according to a first embodiment of the present disclosure with reference to FIGS. 6 to 11. FIGS. 6 and 7 are perspective views of the toner container 30 according to the present embodiment. FIG. 8A is a plan view of the toner container 30, FIG. 8B is its front view, and FIG. 8C is its side view. FIG. 9 is an exploded perspective view of the toner container 30. FIGS. 10A and 10B are perspective views of a movable wall 34 of the toner container 30. FIG. 11 is a sectional view of the toner container 30.

The toner container 30 is substantially in the form of a cylinder. The toner container 30 contains replenishment toner (developer). With reference to FIGS. 9 and 11, the toner container 30 includes a container body 31 (container body), a stirring disc 32, a shaft 33, the movable wall 34, a washer 35 (FIG. 9), a sponge seal 36, a lid 37, a rotary gear 38 (driving transmitter), a cover 39, and screws 40 (FIG. 9).

The container body 31 constitutes the body of the toner container 30 being substantially in the form of a cylinder. The container body 31 includes an inner surface 31K and an internal space 31H (FIGS. 9 and 11). The internal space 31H extends in a longitudinal direction (in a first direction, the direction of an arrow DA in FIGS. 6, 7, and 11) in the form of a cylinder and defined by the inner surface 31K.

The container body 31 includes the bottom portion 311, a top portion 312, a front wall 313, a rear wall 314, a left wall 315, and a flange 316. The bottom portion 311 constitutes the bottom of the container body 31 and is in the form of a half cylinder projecting downward. In other words, the bottom portion 311 has an arc shape in a sectional view perpendicularly intersecting the first direction. The front wall 313 and the rear wall 314 are a pair of side walls standing on the opposite lateral ends of the bottom portion 311. The top portion 312 is disposed above the bottom portion 311 to cover the internal space 31H from above. The left wall 315 joins one end (left end) of each of the bottom portion 311, the front wall 313, the rear wall 314, and the top portion 312 in the first direction to cover the container body 31. The internal space 31H is defined by the bottom portion 311, the top portion 312, the front wall 313, the rear wall 314, and the left wall 315, and also by the lid 37 described later. The internal space 31H includes a storage space 31S defined between the left wall 315 and the movable wall 34 described later. The storage space 31S is a space configured to contain toner in the toner container 30.

As shown in FIG. 9, the container body 31 is open at an end thereof that is opposite to the left wall 315 in the first direction. The flange 316 defines this opening and has an outer diameter greater than that of the opposite end of the container body 31 in the first direction. The flange 316 is attached with the lid 37 described later.

The container body 31 includes a shutter 317, a first guiding portion 318, and the toner discharge port 319 (developer discharge port). The shutter 317 is disposed at one end of the container body 31 in the first direction. The shutter 317 is slidable in the first direction. The shutter 317 is operable to cover (seal) the toner discharge port 319 from the outside of the container body 31, and to expose the toner discharge port 319 to the outside.

The first guiding portion 318 is in the form of a protrusion extending vertically on the outer surface of the left wall 315. The first guiding portion 318 guides mounting of the toner container 30 into the housing 101 in cooperation with a second guiding portion 392 described later.

The toner discharge port 319 is formed in a lower portion of the container body 31 and communicates with the internal space 31H. As shown in FIGS. 8B and 9, the toner discharge port 319 is formed at the one end of the container body 319 in the first direction. The toner discharge port 319 is formed along the arc shape of the bottom portion 311 having a predetermined width in the first direction. Toner contained in the storage space 31S is discharged through the toner discharge port 319 toward the developing device 20. In the present embodiment, as described above, the internal space 31H of the container body 31 is defined by the bottom portion 311, the front wall 313, the rear wall 314, and the top portion 312. Therefore, toner in the storage space 31S concentrates at a mid-portion of the arc-shaped bottom portion 311 by its own weight. This allows toner under conveyance by the movable wall 34 to be efficiently discharged through the toner discharge port 319.

The stirring disc 32 (FIGS. 9 and 11) is in the form of a plate member in the form of a disc. The stirring disc 32 is fixedly attached to a second shaft end portion 332 of the shaft 33 described later, and integrally rotates with the shaft 33. The stirring disc 32 is disposed along the left wall 315 in the storage space 31S of the container body 31. The stirring disc 32 functions to stir toner existing above the toner discharge port 319. The stirring disc 32 may be disposed directly above the toner discharge port 319.

The shaft 33 extends in the first direction in the internal space 31H and is rotatably supported on the container body 31 and the lid 37 described later. The shaft 33 includes a first shaft end portion 331, the second shaft end portion 332, a male thread portion 333 (first engaging portion), and a movable wall stopper portion 334.

The first shaft end portion 331 (FIG. 11) is defined by one end of the shaft 33 in the first direction. The first shaft end portion 331 is axially supported in a lid shaft hole 37J of the lid 37 described later. The second shaft end portion 332 is defined by the other end of the shaft 33 in the first direction. The second shaft end portion 332 is axially supported on a main body bearing 31J (FIG. 11) formed in the left wall 315 of the container body 31. The male thread portion 333 is in the form of a helical thread formed on the outer surface of the shaft 33 in the internal space 31H. In the present embodiment, the male thread portion 333 extends on the shaft 33 from a position facing the flange 316 to a position immediately preceding the toner discharge port 319, as shown in FIG. 11. The movable wall stopper portion 334 is disposed downstream of the male thread portion 333 in the first direction. The movable wall stopper portion 334 is defined by a specific part of the shaft 33, the specific part not bearing the male thread portion 333. The movable wall stopper portion 334 is disposed above the toner discharge port 319.

The movable wall 34 is a wall disposed in the container body 31 and extending in a direction perpendicularly intersecting the first direction. The movable wall 34 defines one end surface (right end surface) of the storage space 31S in the first direction. The other end surface (left end surface) of the storage space 31S is defined by the left wall 315 and the stirring disc 32. The movable wall 34 is moved to the toner discharge port 319 in the first direction from a right end side toward a left end side of the internal space 31H while conveying toner in the storage space 31S toward the toner discharge port 319, during a time period from the beginning of use to the end of use of the toner container 30. The movable wall 34 is movable only in the left direction by a motor M described later.

With reference to FIGS. 10A and 10B, the movable wall 34 includes a conveying wall portion 340, an outer peripheral wall portion 341, an inner wall seal 342, a shaft seal 343, supply opening caps 344, a movable wall shaft hole 34J, and an outer surface 34K.

The conveying wall portion 340 is a wall defining the storage space 31S in cooperation with the inner surface 31K of the container body 31. In particular, the conveying wall portion 340 includes a conveying surface 340S extending perpendicularly to the shaft 33. The conveying surface 340S conveys toner in the storage space 31S by pressing it in accordance with movement of the movable wall 34. The conveying wall portion 340 further includes a carrier bearing 340A, toner supply openings 340B (developer filling port), and a cylinder part 340C. The carrier bearing 340A is a bearing formed in a substantially central part of the conveying wall portion 340. The carrier bearing 340A moves in the first direction while holding the movable wall 34. The above-described shaft 33 is inserted in the carrier bearing 340A. The toner supply openings 340B are formed above the carrier bearing 340A to pass through the conveying wall portion 340 in the first direction. Upon attachment of the movable wall 34 to the container body 31, the toner supply openings 340B communicate with the storage space 31S. Replenishment toner is filled into the storage space 31S through the toner supply openings 340B when the toner container 30 is manufactured.

The cylinder part 340C projects from a surface of the conveying wall portion 340 that is opposite to the conveying surface 340S in the first direction. The cylinder part 340C constitutes a part of the carrier bearing 340A. The cylinder part 340C includes a female thread 340D (second engaging portion). The female thread 340D projects from an inner surface of the cylinder part 340C and is in the form of a helical thread. The female thread 340D functions to move the movable wall 34 in the first direction by engaging with the male thread 333 of the shaft 33. At this time, the engagement of the inner surface of the cylinder part 340C (carrier bearing 340A) and the outer surface of the shaft 33 maintains the conveying wall portion 340 of the movable wall 34 in a vertical posture of perpendicularly intersecting the first direction. This prevents the conveying wall surface 340S of the movable wall 34 from tilting with respect to the shaft 33, which makes it possible to convey a constant amount of toner in the first direction.

The outer peripheral wall portion 341 projects from the outer peripheral edge of the conveying wall portion 340 in a direction away from the storage space 31S, namely, to an upstream direction opposite to the moving direction of the movable wall 34. The outer peripheral wall portion 341 faces the inner surface 31K of the container body 31. The outer peripheral wall portion 341 includes ribs 341A and a discharge port sealing part 341B. The ribs 341A are disposed on the outer peripheral wall portion 341 and extend in the first direction. The ribs 341A are spaced from one another in a circumferential direction of the outer peripheral wall portion 341. The ribs 341A are in slight contact with the inner surface of the 31K, and function to prevent the movable wall 34 from tilting in the first direction in the container body 31. The discharge port sealing part 341B is defined by a lowest part of the outer peripheral wall portion 341 and has a size operable to cover the toner discharge port 319.

The inner wall seal 342 is a sealing member disposed on the outer peripheral wall portion 341 on a rear end joining the conveying wall portion 340 in such a way as to ride on a circumference of the rear end of the outer peripheral wall portion 341. As shown in FIG. 10A, the inner wall seal 342 is fixedly attached to the top of the conveying wall portion 340 at a first seal end 342A thereof, and then fixedly wound around the conveying wall portion 340 to be finally fixed at a second seal end 342B thereof in such a manner that the first seal end 342A and the second seal end 342B overlap each other. The inner wall seal 342 is resiliently compressed between the inner surface 31K of the container body 31 and the outer peripheral wall portion 341 of the movable wall 34. The inner wall seal 342 constitutes a part of the outer surface 34K of the movable wall 34. The outer surface 34K is disposed in close contact with the inner surface 31K of the container body 31. The inner wall seal 342 prevents toner in the storage space 31S from flowing out to the upstream side of the movable wall 34 in the moving direction through a gap between the inner surface 31K of the container body 31 and the movable wall 34.

The shaft seal 343 is disposed on the carrier bearing 340A at a downstream side of the female thread 340D in the moving direction of the movable wall 34 (FIG. 11). The shaft seal 343 comes in contact with the male thread 333 of the shaft 33 in accordance with movement of the movable wall 34. At this time, the shaft seal 343 comes in contact with the male thread 333 prior to the female thread 340D to clean toner adhered on the male thread 333. This allows the male thread 333 to engage with the female thread 340D after toner adhered thereon is removed almost completely. This makes it possible to prevent toner from aggregating between the male thread 333 and the female thread 340D to allow stable movement of the movable wall 34. In addition, the shaft seal 343 is in the form of a ring allowing the shaft 33 to pass therethrough, and is therefore in close contact with the shaft 33 over the entire circumference of the shaft 33. This prevents toner in the storage space 31S from flowing out to the upstream side of the movable wall 34 in the moving direction through the carrier bearing 340A. The movable wall shaft hole 34J is formed inside the shaft seal 343 in the form of a ring and the cylinder part 340C, the movable wall shaft hole 34J for allowing the shaft 33 to pass therethrough.

The supply opening cap 344 is fitted in the toner supply opening 340B through the inside of the outer peripheral wall portion 341 to seal the toner supply opening 340B, as shown in FIG. 10B. After replenishment toner is filled in the container space 31S through the toner supply openings 340B, the supply opening caps 344 are respectively fitted into the toner supply openings 340B. This makes it possible to prevent toner from leaking through the toner supply openings 340B.

The washer 35 (FIG. 9) is fitted on the shaft 33 between the cylinder part 340C of the movable wall 34 and the sponge seal 36.

The sponge seal 36 is disposed between the washer 35 and the lid 37. The sponge seal 36 is operable to prevent toner from leaking through the lid shaft hole 37J of the lid 37 described later, with the lid 37 being fixedly attached to the container body 31.

The lid 37 (FIGS. 9 and 11) is fixedly attached to the flange 316 (the other end of the container body 31) of the container body 31 and seals the opening of the container body 31. The lid 37 includes the lid shaft hole 37J. The lid shaft hole 37J rotatably supports the shaft 33 at the first shaft end 331.

The rotary gear 38 is fixedly attached to the first shaft end portion 331 of the shaft 33. A tip end of the first shaft end portion 331 is in the shape of D in a sectional view perpendicularly intersecting its axial direction. The rotary gear 38 is formed with an unillustrated D hole in a central part thereof, the D hole engaging with the tip end of the first shaft end portion 331 having the D-shape. The rotary gear 38 is integrally rotatable with the shaft 33. The rotary gear 38 includes outer peripheral gear teeth 381. The outer peripheral gear teeth 381 are formed in an outer peripheral portion of the rotary gear 38. The outer peripheral gear teeth 381 are not shown in the drawings. The rotary gear 38 is connected to the motor M (FIG. 8B) disposed in the housing 101 of the printer 100. Upon receipt of a rotational driving force from the motor M, the rotary gear 38 transmits the rotational driving force to the shaft 33 to move the movable wall 34 in the first direction.

The cover 39 is a cover member disposed at an end of the toner container 30. With reference to FIG. 8C, the cover 39 has a shape to cover a half of the circular end surface of the rotary gear 38. In other words, upon fixed attachment of the cover 39 to the container body 31 via the lid 37, the other half of the end surface of the rotary gear 38 is exposed to the outside of the toner container 30. The cover 39 includes a shaft cover portion 391 and the second guiding portion 392. The shaft cover portion 391 is in the form of a cylinder formed in a central part of the cover 39. The shaft cover portion 391 covers the end of the first shaft end portion 331 projecting from the rotary gear 38. The second guiding portion 392 is in the form of a protrusion extending in a vertical direction and behind the shaft cover portion 391. The second guiding portion 392 functions to guide mounting of the toner container 30 into the printer 100.

Each of the screws 40 is fastened to the flange 316 of the container body 31 after being inserted into unillustrated screw holes respectively formed in the lid 37 and the cover 39. Consequently, the container body 31, the lid 37, the rotary gear 38, and the cover 39 constitute an integral structure, with the stirring disc 32, the shaft 33, and the movable wall 34 being disposed in the internal space 31H.

Further, the toner container 30 includes a toner sensor 31T (FIGS. 8A and 8B). The toner sensor 31T is disposed on the top portion 312 of the container body 31 above the toner discharge port 319. The toner sensor 31T includes a magnetic permeability sensor or a piezoelectric element. In the case where the toner sensor 31T includes a piezoelectric element, a sensing portion of the toner sensor 31T is exposed to the storage space 31S. The toner sensor 31T outputs a HIGH signal (+5V) in response to being pressed by toner in the storage space 31S. When no toner exists directly under the toner sensor 31T, the toner sensor 31T outputs a LOW signal (0V). A signal outputted by the toner sensor 31T will be referred to by a controller 50 described later. In the case where the toner sensor 31T is a magnetic permeability sensor, the sensor does not need to make direct contact with toner. Therefore, in other embodiments, the toner sensor 31T may be disposed on the housing 101 of the printer 100 so as to face the outer surface of the container body 31. Further, the toner sensor 31T is not limited to be disposed on the top portion 312. In other embodiments, the toner sensor may be disposed on any one of the bottom portion 311, the front wall 31, and the rear wall 314 near the toner discharge port 319. In the case where the toner sensor is disposed on a lowest part of the bottom portion 311, the toner discharge port 319 may be formed at a position circumferentially away from the lowest part.

<Function of Toner Container>

As described above, the toner container 30 can be attached to and detached from the developing device 20. With reference to FIG. 2, when the opening/closing cover 100C is opened upward, a container housing space 109 is exposed to the outside of the housing 101, the container housing space 109 constituting a part of the main body internal space 107. In the present embodiment, the toner container 30 is mounted in the container housing space 109 from above (see an arrow DC shown in FIGS. 6 and 7). At this time, the cover 39 of the toner container 30 comes to rest at a right end of the container housing space 109, and the left wall 315 of the toner container 30 comes to rest at the left end of the container housing space 109. The printer 100 includes guide grooves 109A (FIG. 2). The guide grooves 109A are grooves vertically extending in the container housing space 109. Although FIG. 2 shows only a right guide groove 109A, there is also a left guide groove 109A similarly disposed at the left end of the container housing space 109.

The toner container 30 is mounted into the container storage 109 by a user, with the first guiding portion 318 and the second guiding portion 392 respectively engaging with the pair of guide grooves 109A. When the toner container 30 is mounted in the container storage space 109, a user or an unillustrated opening/closing mechanism slides the shutter 317 to open the toner discharge port 319. Consequently, the toner discharge port 319 lies above and faces the toner discharge port 25 (FIGS. 4 and 5).

Figure 12A:
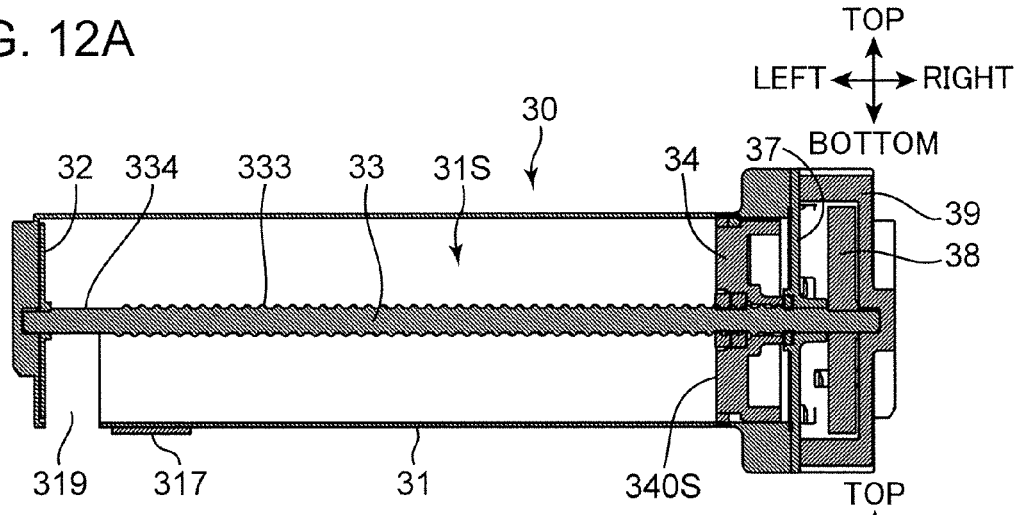
FIG. 12A, FIG. 12B, and FIG. 12C illustrate movement of the movable wall in the developer container according to the first embodiment of the present disclosure.
Figure 12B:
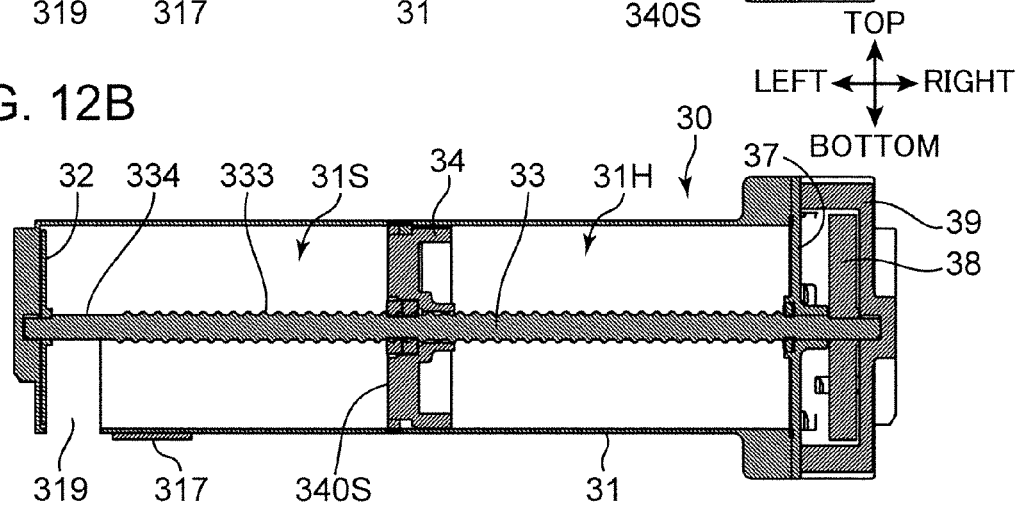
Figure 12C:
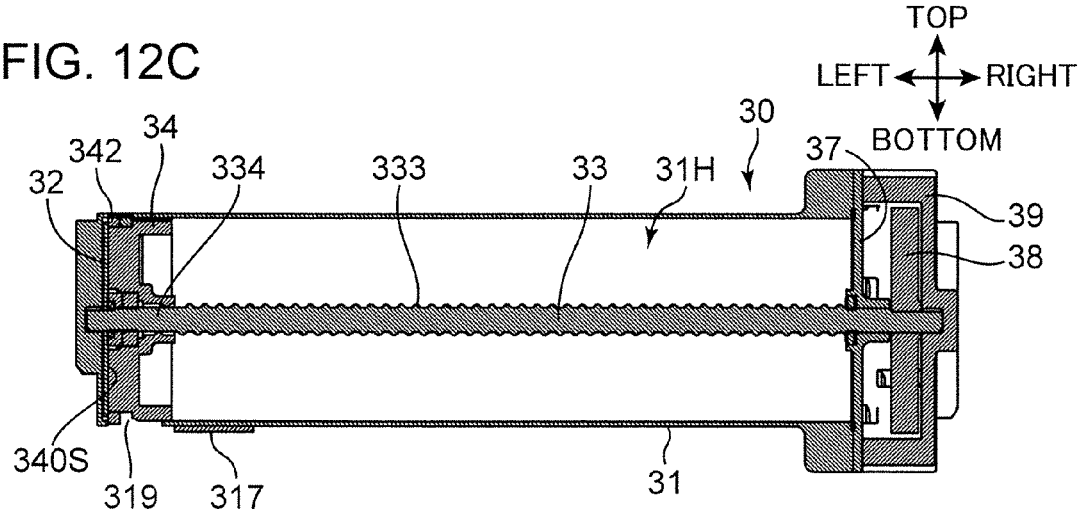

FIGS. 12A, 12B, and 12C are sectional views illustrating the movement of the movable wall 34 in the toner container 30. FIG. 12A shows the movable wall 34 at an initial position. FIG. 12B shows the movable wall 34 having moved from the initial position in the first direction. FIG. 12C shows the movable wall 34 at a final position.

As shown in FIG. 12A, when the toner container 30 is newly mounted in the printer 100 by a user, the movable wall 34 lies at the initial position at the lid 37 remote from toner discharge port 319. Even if the storage space 31S is maximally filled with toner when the toner container 30 is manufactured, a slight space will remain in the storage space 31S. This space is necessary to impart a predetermined fluidity to the toner contained in the storage space 31S before use of the toner container 30. However, in this case, because a boundary surface (top surface) of the toner contained in the storage space 31S is located below the top portion 312 with a specific gap therebetween, the toner sensor 31T can be seen to be difficult to detect the toner contained in the storage space 31S with high accuracy.

Accordingly, when the toner container 30 is newly mounted in the printer 100, the controller 50 (FIG. 8B) causes the motor M to drive the rotary gear 38 and the shaft 33 for rotation. This brings the male thread 333 into engagement with the female thread 340D to thereby move the movable wall 34 in the first direction toward the toner discharge port 319. When the movable wall 34 has moved slightly leftward from the initial position shown in FIG. 12A, the storage space 31S is filled up with the toner. This allows the toner sensor 31T to detect the toner in the storage space 31S. Upon receipt of the HIGH signal outputted from the toner sensor 31T, the controller 50 causes the movement of the movable wall 34 to stop. In this manner, it is possible to fill up the storage space 31S with toner as an initial setup of the toner container 30. This makes it possible to discharge a constant amount of toner through the toner discharge port 319. Further, because it is possible to secure an empty space in the storage space 31S when the toner container 30 is carried, aggregation of toner can be prevented. Further, because it is possible to detect a toner full state in the storage space 31S by the toner sensor 31T, the toner can be prevented from being excessively pressed by the movable wall at an initial stage.

In the present embodiment, the inner surface 31K of the container body 31 and the outer surface 34K (outer peripheral wall portion 341) of the movable wall 34 each have, in a sectional view perpendicularly intersecting the first direction, a non-true circular shape.

This makes it possible to prevent the movable wall 34 from rotating with respect to the container body 34 even when the movable wall 34 receives a force for rotation around the shaft 33 generated by the engagement of the male thread 333 and the female thread 340D. Consequently, it is possible to move the movable wall 34 stabilizedly in the first direction by a rotational driving force of the motor M. In addition, the engagement of the male thread 333 and the female thread 340D makes it possible to move the movable wall 34 stabilizedly in the first direction with the outer surface 34K of the movable wall 34 being in close contact with the inner surface 31K of the container body 31 as described above.

As described above, the present embodiment employs the volume replenishment type supply method as shown in FIG. 5. Therefore, when the toner supply port 25 is sealed by the accumulation portion 29 (FIG. 5) located in the developing device 20 from below, no replenishment toner falls from the toner container 30. On the other hand, when the amount of toner of the accumulation portion 29 has decreased due to supply of toner from the developing roller 21 of the developing device 20 to the photoconductive drum 121, toner flows into the developing device 20 from the toner discharge port 319 through the toner supply port 25. Consequently, toner that has existed under the toner sensor 31T disappears in the storage space 31S of the toner container 30, which causes the toner sensor 31T to output a LOW signal. Upon receipt of the signal, the controller 50 causes the motor M to run to move the movable wall 34 toward the toner discharge port 319 (FIG. 12B) until the toner sensor 31T outputs a HIGH signal. At this time, the stirring disc 32 disposed at an extreme end of the storage space 31S rotates with the shaft 33 to stir toner existing above the toner discharge port 319. This increases the fluidity of toner, so that the toner falls through the toner discharge port 319 constantly.

When toner has been consumed from the storage space 31S of the toner container 30, the movable wall 34 finally comes to the final position closer to the toner discharge port 319 shown in FIG. 12C. In this manner, the movable wall 34 gradually moves in the first direction to convey toner in the storage space 31S to the toner discharge port 319 by pressing it. At this time, the storage space 31S gradually decreases as the movable wall 34 approaches the toner discharge port 319. This allows the space accommodating the remaining toner to gradually disappear in the toner container 30. Finally, at the final position shown in FIG. 12C, the movable wall 34 comes into contact with the stirring disc 32, so that the storage space 31S almost disappears. This makes it possible to reduce the amount of toner remaining in the storage space 31S of the container body 31 at the end of use of the toner container 30, compared to the conventional toner container whose storage space volume does not change.

When the movable wall 34 has reached the final position facing the toner discharge port 319, the discharge port sealing part 341B (FIG. 10B) of the movable wall 34 covers the toner discharge port 319 from the inside of the container body 31 (FIG. 12C). In other words, the movable wall 34 has a shutter function of covering the toner discharge port 319 when toner in the container body 31 has run out. This makes it possible to, even when the toner container 30 is dismounted from the printer 100 with the shutter 317 left open, prevent a small amount of toner remaining in the gap between the stirring disc 32 and the movable wall 34 from leaking out of the toner discharge port 319. In particular in the present embodiment, the inner wall seal 342 being in close contact with the inner surface 31K of the container body 31 is located at a downstream end of the movable wall 34 in the moving direction during the moving process of the movable wall 34. This allows the discharge port sealing part 341B covering the toner discharge port 319 to be hardly adhered with toner, the discharge port sealing part 341B being located at an upstream side of the inner wall seal 342 in the moving direction of the movable wall 34. In addition, the width of the outer peripheral wall portion 341 is configured to be longer than the width of the toner discharge port 319 in the first direction, so that the discharge port sealing part 341B has a size to cover the toner discharge port 319. This makes it possible to reliably cover the toner discharge port 319 by the discharge port sealing part 341B.

Further, when the movable wall 34 has sealed the toner discharge port 319 at the final position as described above, a user can recognize that the toner container 30 is empty by seeing the sealing state. When the amount of toner remaining in the toner container 30 has decreased, it is difficult to tell the amount of remaining toner by the weight of the toner container 30. On the other hand, in the case where the shutter 317 is slid as described above, a user can reliably recognize, by seeing that the toner discharge port 319 is already sealed by the movable wall 34, that toner in the toner container 30 has run out. Consequently, the user can be prompted to replace the toner container 30.

Further, the above-described function of the movable wall 34 of sealing the toner discharge port 319 can be also utilized in the case where a toner container 30 that has been partially used is dismounted from the printer 100 for some reason and stored with other empty toner containers 30. Specifically, a user is only required to choose a specific one of the plurality of stored toner containers 30, the specific one in which the toner discharge port 319 is not sealed by the movable wall 34.

In addition, in the case where the volume replenishment type toner supply method is employed as described above, when toner in the toner container 30 has run out, the accumulation portion 29 receives little pressure from the replenishment toner and therefore no pressing force is exerted to the developing device 20 from the toner container 30. In this case, there is a possibility that a part of the toner in the developing device 20 flows back toward the toner discharge port 319 through the toner supply port 25 because of various conditions in the developing device 20. However, in the present embodiment, the movable wall 34 seals the toner discharge port 319, which makes it possible to prevent the toner from flowing back into the container body 31 from the developing device 20 (supply receiver).

In addition, in the present embodiment, the toner supply openings 340B for filling toner into the storage space S are formed in the movable wall 34 when the toner container 30 is manufactured, as described above. Therefore, there is no need to form a filling port in the container body 31 in addition to the toner discharge port 319. This makes it possible to form the container body 31 in a simple shape. There may be provided toner containers 30 filled with different amounts of toner by varying the initial position of the movable wall 34 in the first direction. It is possible to change the volume of the storage space 31 by changing the initial position of the movable wall 34 at the time of filling toner. Also in this case, the toner supply openings 340B are formed in the movable wall 34 of each of the toner containers 31 and, therefore, it is not necessary to form a filling port in a container body 31 of each of the toner containers 30 at different positions from one another according to the amount of toner to be filled. This allows common use of a single container body 31 for each of the toner containers 31. Even in the case where toner containers 30 are filled with different amounts of toner, the initial position of the movable wall 34 of each of the toner containers 30 may be commonly set at a position shown in FIG. 12A. In this case, when the toner container 30 is mounted in the printer 100, a driving time for allowing the motor M to run is adjusted according to an output signal of the toner sensor 31T as an initial setting. Consequently, the storage space 31S is filled up with toner.

Further, as shown in FIGS. 11 and 12A, the toner container 30 according to the present embodiment includes the movable wall stopper portion 334. The movable wall stopper portion 334 is defined by a specific part of the shaft 33, the specific part not bearing the male thread 333 and facing the toner discharge port 319, as described above. This allows the female thread 340D (FIG. 10B) of the movable wall 34 to disengage from the male thread 333 and come to face the movable wall stopper portion 334 immediately before the movable wall 34 reaches the final position shown in FIG. 12C. In other words, once the movable wall 34 has reached the final position shown in FIG. 12C, the female thread 340D is prevented from reengaging with the male thread 333. As a result, the movable wall 34 never moves back toward the lid 37 even if the rotary gear 38 is inversely rotated by mistake. Therefore, as described above, it is possible to reliably locate the movable wall 34 at the final position when toner in the toner container 30 has run out. Further, even in the case where a used toner container 30 is stored in a vertical orientation so that the first direction agrees with a vertical direction, the movable wall 34 is prevented from moving back toward the lid 37 by its own weight.

Further, at the final position shown in FIG. 12C, the inner wall seal 342 of the movable wall 34 resiliently biases the inner surface 31K of the toner container 30 radially from the inside of the inner surface 31K. This allows the movable wall 34 to be stably locked at the final position to be further prevented from moving backward.

Figure 13A:
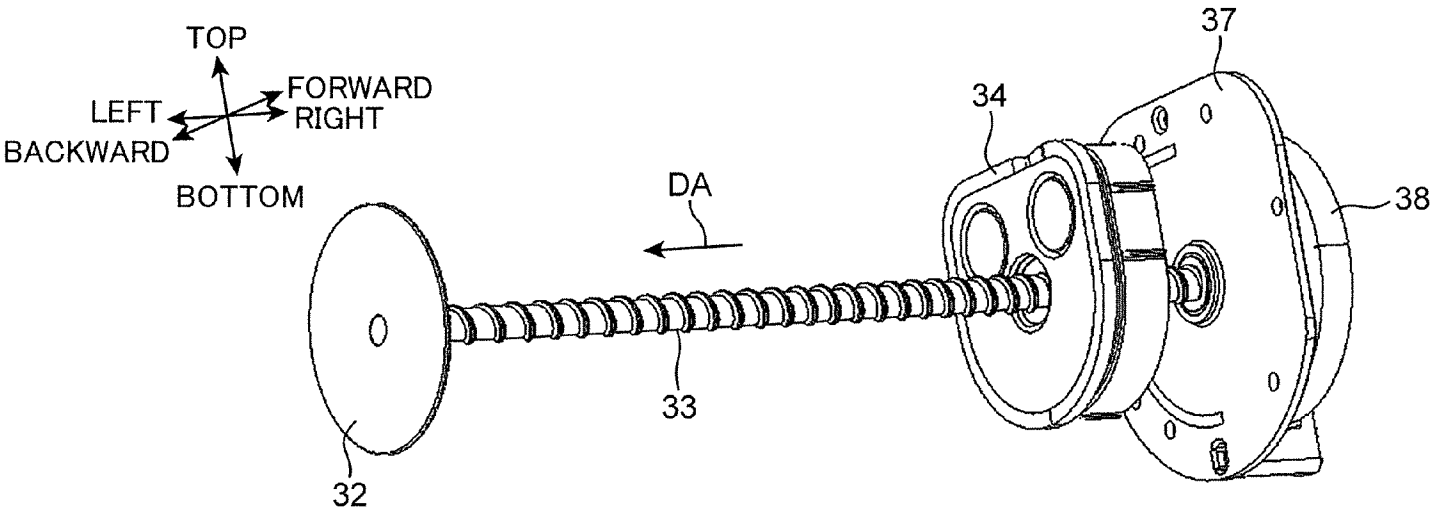
FIG. 13A is a perspective view showing the inside of the developer container according to the first embodiment of the present disclosure, and FIG. 13B being a perspective view of a shaft of the developer container.
Figure 13B:
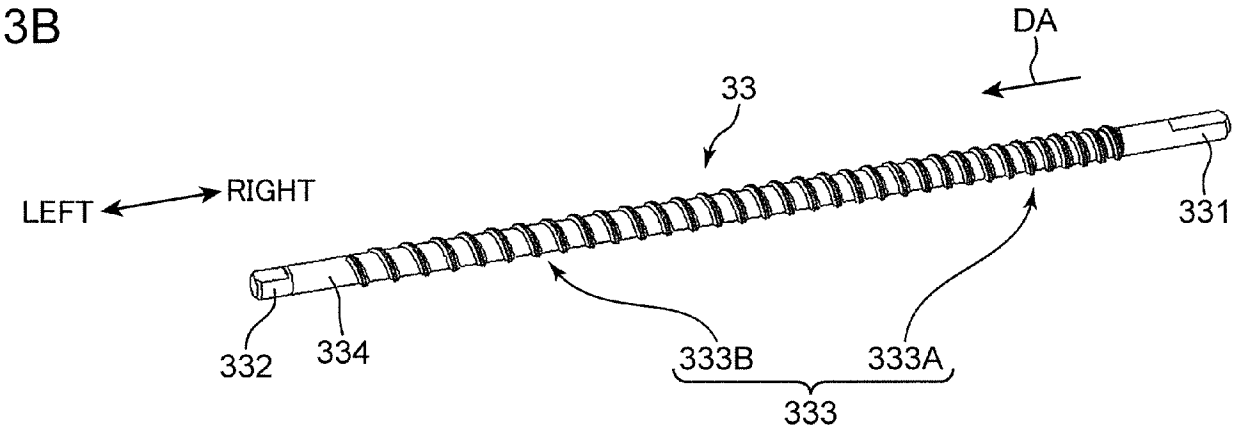

FIG. 13A is a perspective view showing an internal structure of the toner container 30. FIG. 13B is a perspective view of the shaft 33. In FIGS. 9, 11 and FIGS. 12A to 12C, the male thread portion 333 of the shaft 33 is illustrated as having a constant pitch for the purpose of simplifying the description. However, the thread pitch of the male thread portion 333 varies in the first direction in a detailed view, as shown in FIGS. 13A and 13B.

Specifically, the male thread portion 333 includes a first pitch part 333A (small pitch part) and a second pitch part 333B. The first pitch part 333A constitutes an upstream part of the male thread portion 333 in the moving direction of the movable wall 34 (in the direction of an arrow DA shown in FIGS. 13A and 13B). The first pitch part 333A bears the initial position of the movable wall 34. The second pitch part 333B is disposed downstream of the first pitch part 333A in the moving direction of the movable wall 34. A downstream end of the second pitch part 333B is adjacent to the movable wall stopper portion 334 in the moving direction. The second pitch part 333B has a greater thread pitch than the first pitch part 333A. The first pitch part 333A includes a subpart which is continuous to the second pitch part 333B and has a thread pitch gradually increasing as advancing to the second pitch part 333B.

This configuration of the male thread portion 333 allows the movable wall 34 to move in the first direction at a low speed at an initial stage of use of the toner container 30 when a large amount of toner is stored in the storage space 31S. This can prevent the movable wall 34 from strongly pressing a large amount of toner into the toner discharge port 319. Therefore, it is possible to prevent an increase in the rotational torque of the shaft 33 at the initial stage. Further, because toner is prevented from being strongly pressed by the conveying surface 340S of the movable wall 34, it is possible to prevent discharge of a large amount of toner through the toner discharge port 319. In particular, in the case where the volume replenishment type toner supply method is employed as described above, it is possible to prevent aggregation of a large amount of toner between the toner discharge port 319 and the toner supply port 25. Further, because the pitch of the male thread portion 333 gradually increases from the first pitch part 333A to the second pitch part 333B, it is possible to prevent an abrupt change in the moving speed of the movable wall 34 and to reduce fluctuations in the rotational torque of the shaft 33.

Figure 14:
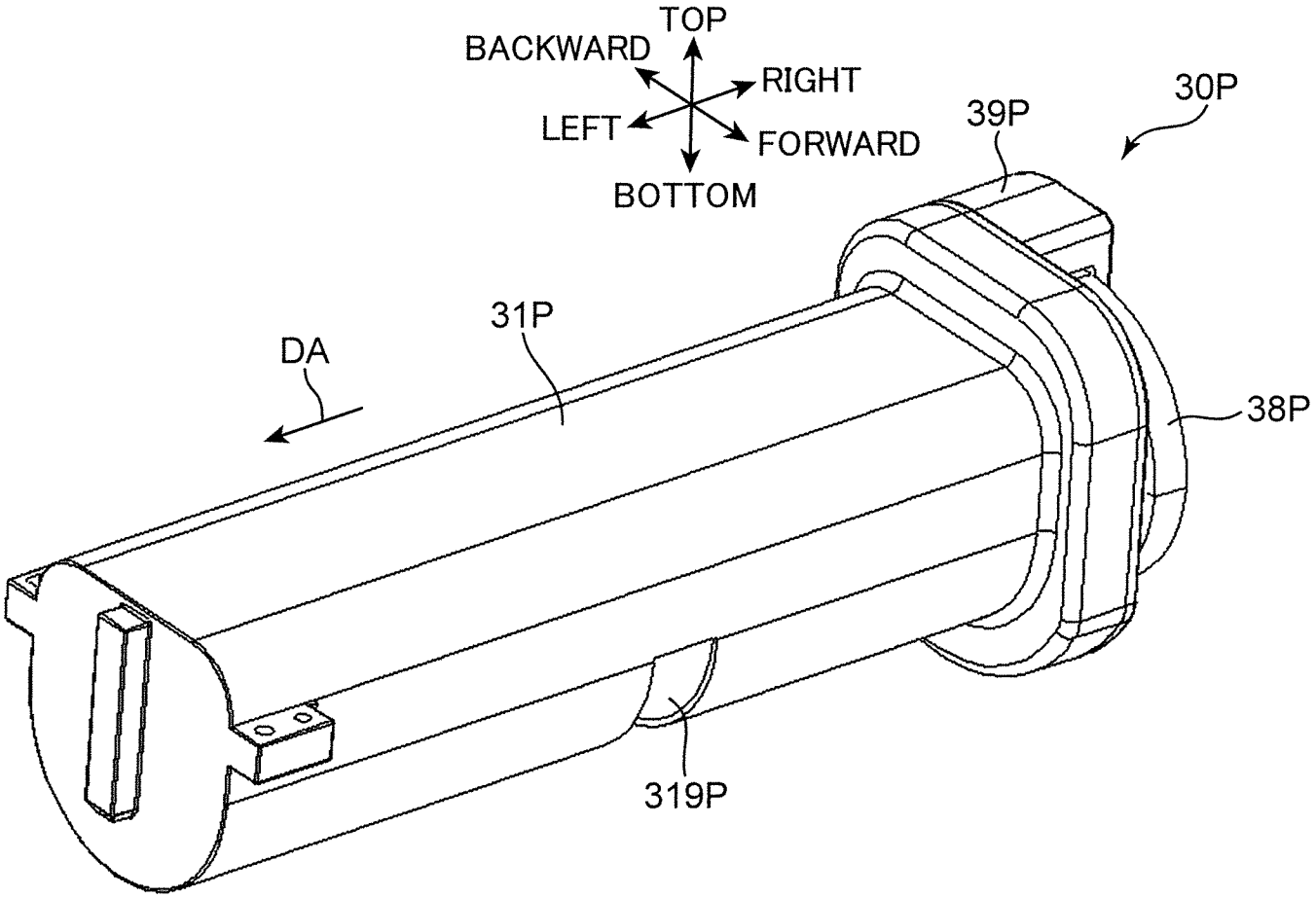
FIG. 14 is a perspective view of a developer container according to a second embodiment of the present disclosure.
Figure 15:
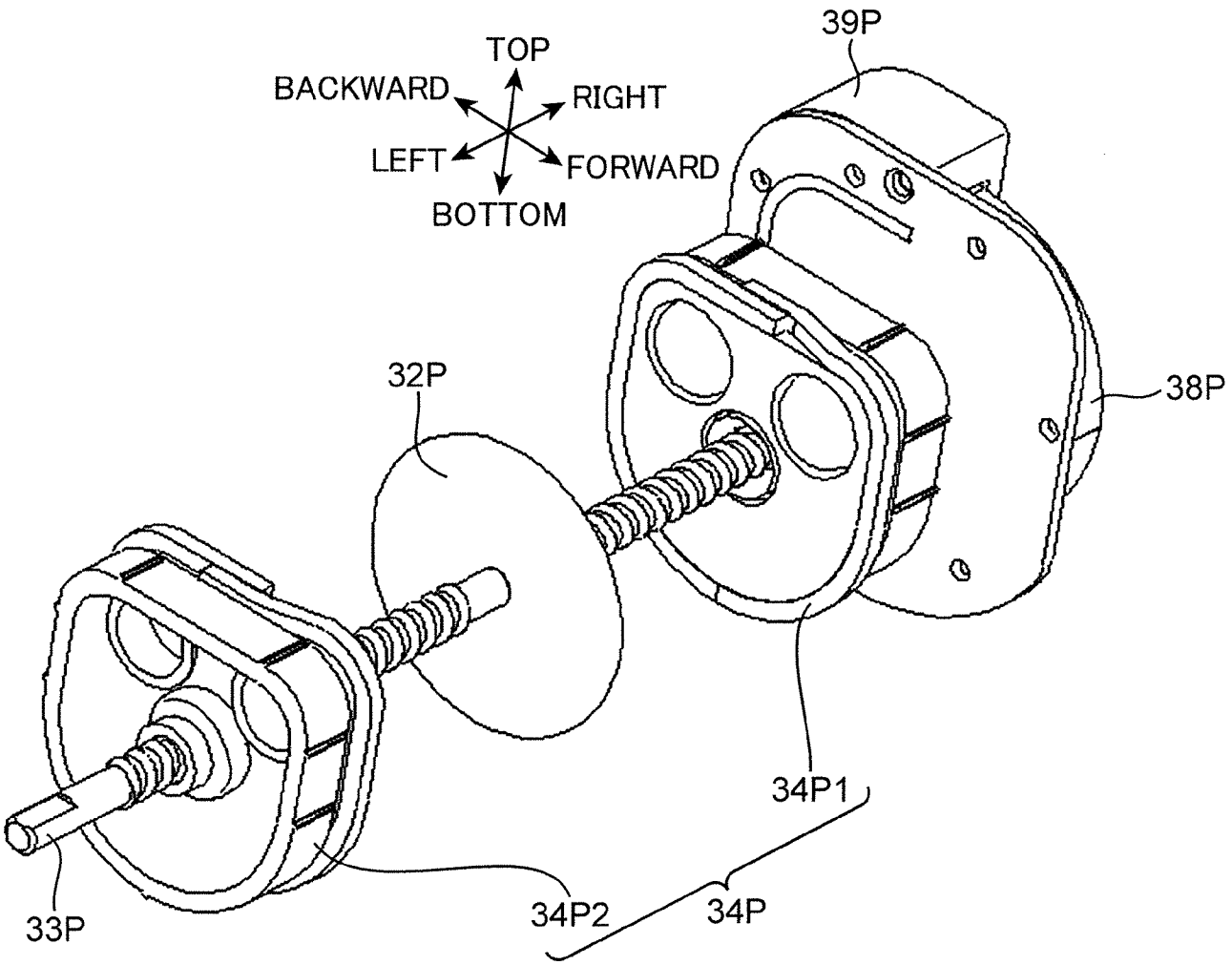
FIG. 15 is a perspective view showing the inside of the developer container according to the second embodiment of the present disclosure.
Figure 16A:
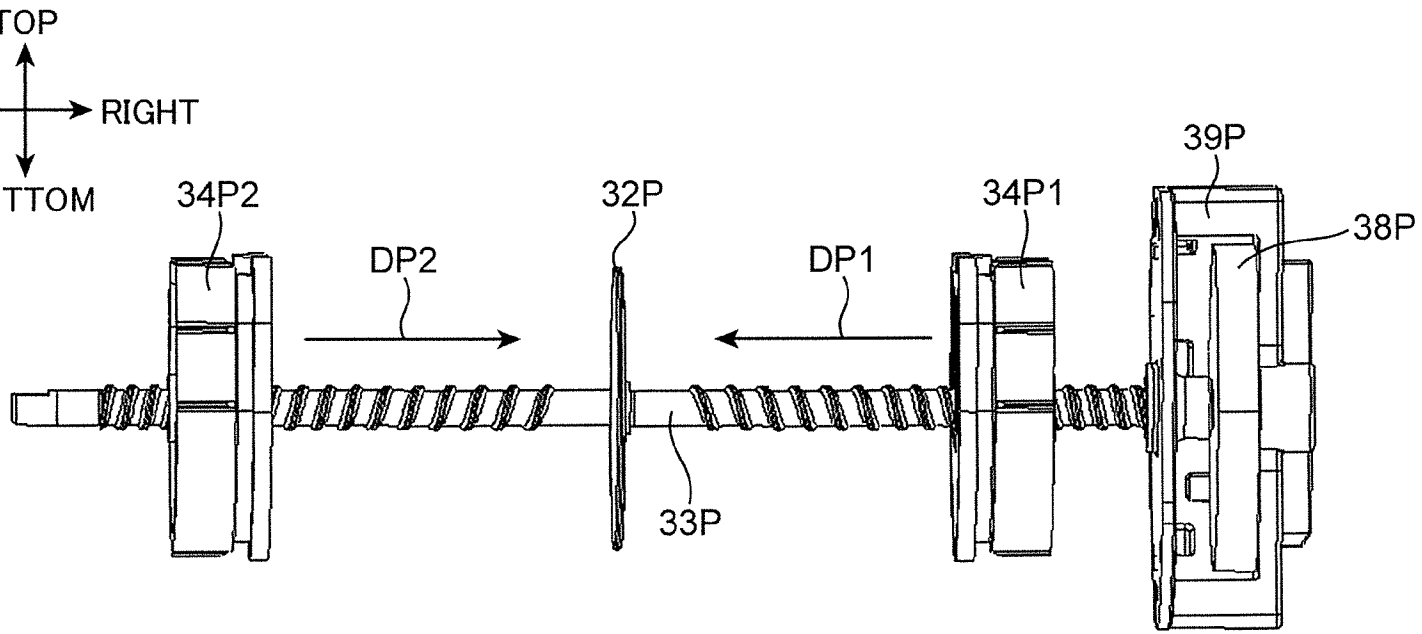
FIG. 16A is a front view showing the inside of the developer container according to the second embodiment of the present disclosure, and FIG. 16B being a front view of a shaft of the developer container shown in FIG. 16A.
Figure 16B:
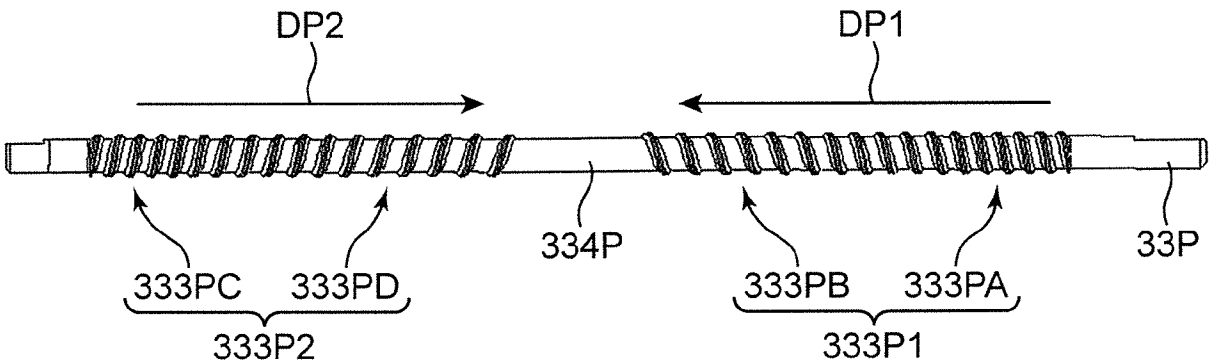

Now, a toner container 30P according to a second embodiment of the present disclosure will be described with reference to FIGS. 14 to 16B. FIG. 14 is a perspective view of the toner container 30P. FIG. 15 is a perspective view showing the inside of the toner container 30P. FIG. 16A is a front view showing the inside of the toner container 30P, and FIG. 16B is a front view of a shaft 33P of the toner container 30P. In these drawings, elements that have functions identical to those of the corresponding elements of the toner container 30 in the first embodiment are denoted by the same reference numerals as in the first embodiment, with P added at the end. The second embodiment differs from the toner container 30 of the first embodiment in the aspect of including two movable walls. Accordingly, description will be made mainly regarding the difference, and repeated description of other common features will be omitted. Though not shown in FIG. 14, an unillustrated shutter is slidably disposed at the toner container 30P in such a manner as to face the toner discharge port 319P, similarly to the shutter 317 of the first embodiment.

With reference to FIG. 14, the toner container 30P includes a container body 31P, a toner discharge port 319P, a rotary gear 38P, and a cover 39P. In the first embodiment, the toner discharge port 319 is disposed at the left end of the container body 31. However, the toner discharge port 319P is disposed between a left end and a right end of the container body 31P. Specifically, the toner discharge port 319P is disposed at the middle of the container body 31P in the first direction.

With reference to FIGS. 15 and 16A, the toner container 30P includes a stirring disc 32P, the shaft 33P, and a movable wall 34P in the container body 31P. The shaft 33P extends in the first direction in an internal space of the container body 31P and is rotatably supported on the container body 31P. The shaft 33P is rotationally driven to move the movable wall 34P. The shaft 33P includes a first thread portion 333P1 (first engaging portion), a second thread portion 333P2 (first engaging portion), and a movable wall stopper portion 334P. The first thread portion 333P1 and the second thread portion 333P2 are thread portions formed on an outer surface of the shaft 33P for moving the movable wall 34. The movable wall stopper portion 334P is defined by a specific part of the shaft 33P, the specific part being located between the first thread portion 333P1 and the second thread portion 333P2 and bearing no thread portion. The stirring disc 32P is a disc member disposed in the middle of the movable wall stopper portion 334P in the first direction, and rotates integrally with the shaft 33P. The movable wall stopper portion 334P and the stirring disc 32P are located above the toner discharge port 319P (FIG. 14).

In the second embodiment, the movable wall 34P includes a first movable wall 34P1 and a second movable wall 34P2 including respective conveying surfaces 340S (FIG. 10A) facing each other. In other words, the movable wall 34P includes two movable walls. The first movable wall 34P1 and the second movable wall 34P2 each include therein an unillustrated female thread portion (second engaging portion). Upon transmission of a rotational driving force from the rotary gear 38P to the shaft 33P, the first movable wall 34P1 and the second movable wall 34P2 move along the first thread portion 333P1 and the second thread portion 333P2, respectively. In the first embodiment, the movable wall 34 moves from the right end of the container body 31 to the toner discharge port 319 in the first direction. In the second embodiment, the second movable wall 34P2 moves from a left end of the container body 31P to the toner discharge port 319P in the first direction. The first movable wall 34P1 moves from a right end of the container body 31P to the toner discharge port 319P in the first direction. Toner that has been conveyed to a mid-portion of the container body 31P by the two movable walls is discharged through the toner discharge port 319P while being stirred by the stirring disc 32P. When toner in the container body 31P has run out, the first movable wall 34P1 and the second movable wall 34P2 move toward the toner discharge port 319P disposed in the container body 31P to approach each other, and then finally come to rest at a final position (not shown) above the toner discharge port 319P so as to sandwich the stirring disc 32P.

Also in the second embodiment, the storage space of the container body 31P is gradually decreased in the first direction. When the first movable wall 34P1 and the second movable wall 34P2 have reached the toner discharge port 319P, the storage space almost disappears. This allows the toner in the storage space to be efficiently discharged through the toner discharge port 319P.

Further, also in the second embodiment, the first thread portion 333P1 includes a first pitch part 333PA (small pitch part) and a second pitch part 333PB (FIG. 16B). In addition, the second thread portion 333P2 includes a first pitch part 333PC (small pitch part) and a second pitch part 333PD. The first pitch parts 333PA and 333PC bear initial positions of the first movable wall 34P1 and the second movable wall 34P2, respectively. The second pitch parts 333PB and 333PD are disposed downstream of the first pitch parts 333PA and 333PC, respectively, and have a greater thread pitch than the first pitch parts 333PA and 333PC. This can prevent toner from being strongly sandwiched by the first movable wall 34P1 and the second movable wall 34P2 at an initial stage of their movement. Therefore, it is possible to prevent the toner from aggregating, which leads to rotation of the shaft 33Q at a reduced torque.

Figure 17A:
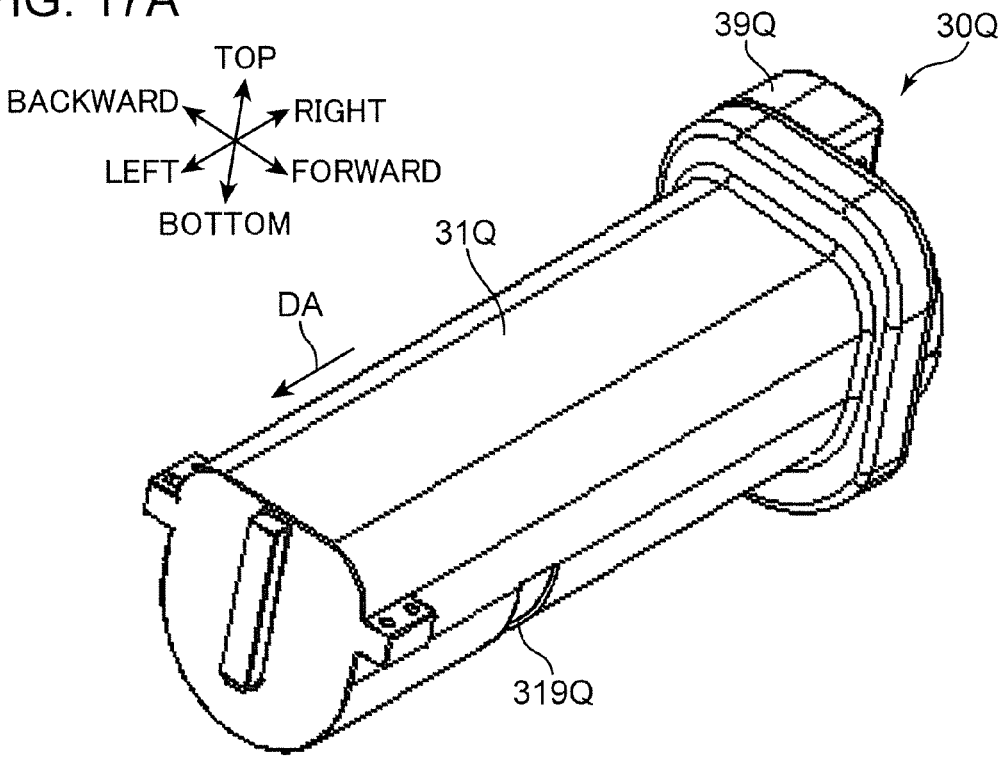
FIG. 17A is a perspective view of a developer container according to a third embodiment of the present disclosure, and FIG. 17B being a perspective view showing the inside of the developer container shown in FIG. 17A.
Figure 17B:
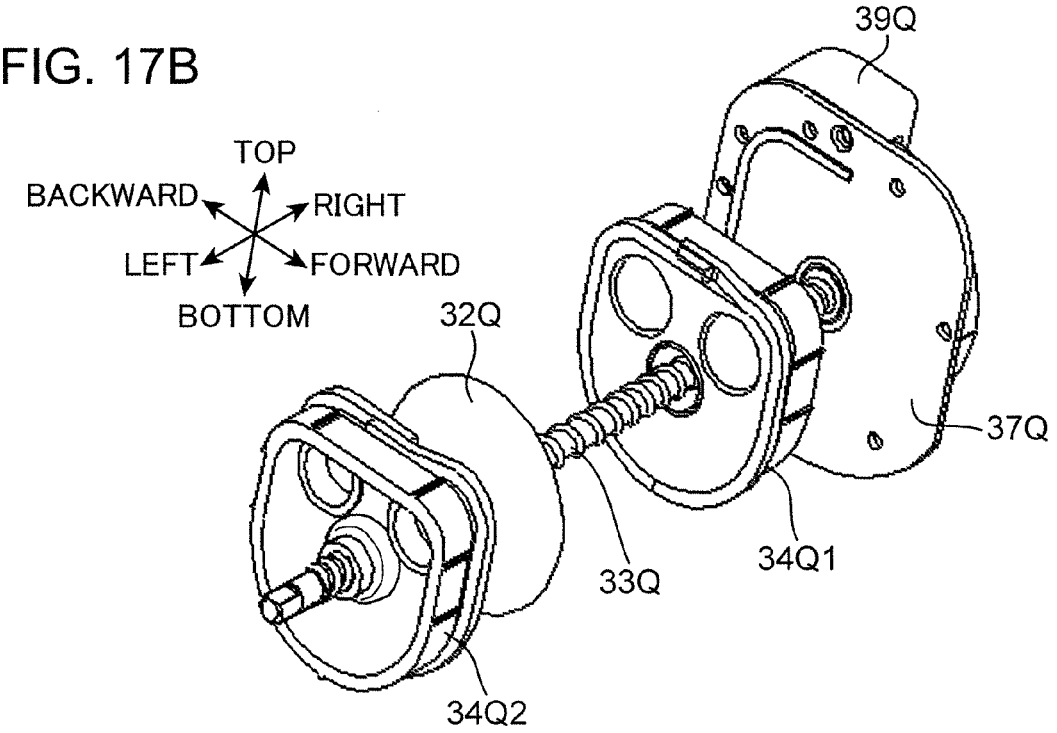
Figure 18A:
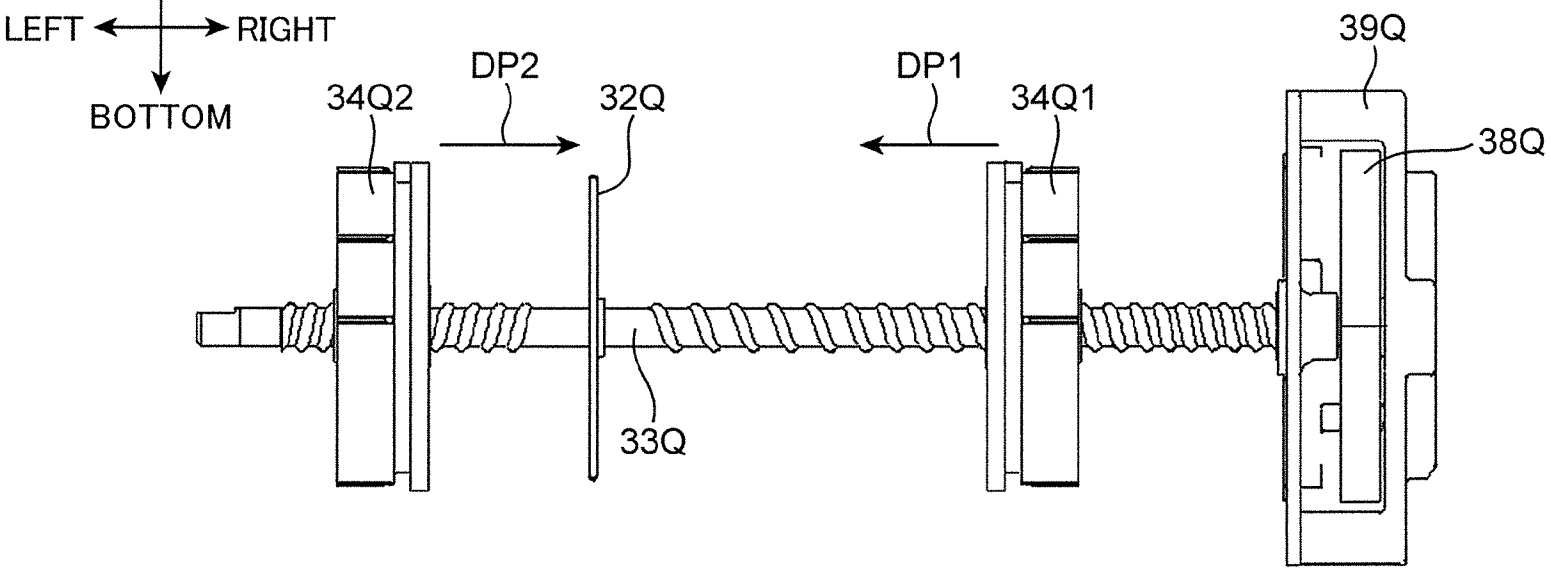
FIG. 18A is a front view showing the inside of the developer container according to the third embodiment of the present disclosure, and FIG. 18B being a front view of a shaft of the developer container shown in FIG. 18A.
Figure 18B:
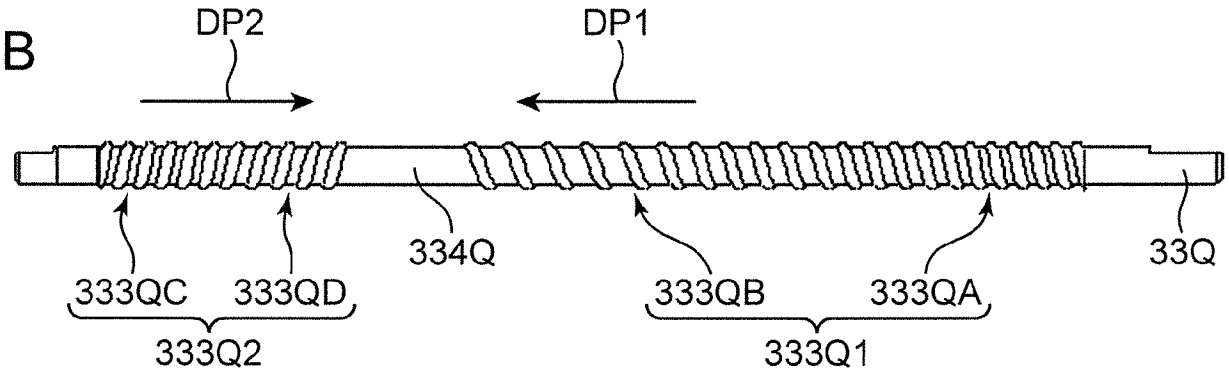

Now, a toner container 30Q according to a third embodiment of the present disclosure will be described with reference to FIGS. 17A to 18B. FIG. 17A is a perspective view of the toner container 30Q. FIG. 17B is a perspective view showing the inside of the toner container 30Q. FIG. 18A is a front view showing the inside of the toner container 30Q, and FIG. 18B is a front view of a shaft 33Q of the toner container 30Q. In these drawings, elements that have functions identical to those of the corresponding elements of the toner container 30 in the first embodiment are denoted by the same reference numerals as in the first embodiment, with Q added at the end. The third embodiment differs from the toner container 30P of the second embodiment in the position of a toner discharge port 319Q and the structure of the shaft 33Q. Accordingly, description will be made mainly regarding the difference, and repeated description of other common features will be omitted. Though not shown in FIG. 17A, an unillustrated shutter is slidably disposed at the toner container 30Q in such a manner as to face the toner discharge port 319Q, similarly to the shutter 317 of the first embodiment.

With reference to FIG. 17A, the toner container 30Q includes a container body 31Q, the toner discharge port 319Q, a lid 37Q, a rotary gear 38Q, and a cover 39Q. In the second embodiment, the toner discharge port 319P is disposed at the middle of the container body 31P in the left/right direction. However, the toner discharge port 319Q is disposed at a position shifted to a left wall 315Q from the middle between left and right ends of the container body 31Q.

With reference to FIGS. 17B and 18A, the toner container 30Q includes a stirring disc 32Q, the shaft 33Q, and a first movable wall 34Q1 and a second movable wall 34Q2 (movable walls). The shaft 33Q includes a first thread portion 333Q1 (first engaging portion), a second thread portion 333Q2 (first engaging portion), and a movable wall stopper portion 334Q. The first movable wall 34Q1 moves from the right end of the tonner container 30Q to the toner discharge port 319Q (in the direction of an arrow DP1 shown in FIG. 18A), and the second movable wall 34Q2 moves from the left end of the toner container 30Q to the toner discharge port 319Q (in the direction of an arrow DP2 shown in FIG. 18A). The first movable wall 34Q1 and the second movable wall 34Q2 each include therein an unillustrated female thread portion (second engaging portion).

Also in the third embodiment, the first thread portion 333Q1 includes a first pitch part 333QA (small pitch part) and a second pitch part 333QB (FIG. 18B). In addition, the second thread portion 333Q2 includes a first pitch part 333QC (small pitch part) and a second pitch part 333QD. The first pitch parts 333QA and 333QC bear initial positions of the first movable wall 34Q1 and the second movable wall 34Q2, respectively. The second pitch parts 333QB and 333QD are disposed downstream of the first pitch parts 333QA and 333QC, and have a greater thread pitch than the first pitch parts 333QA and 333QC, respectively. This can prevent toner from being strongly sandwiched by the first movable wall 34Q1 and the second movable wall 34Q2 at an initial stage of their movement. Therefore, it is possible to prevent the toner from aggregating, which leads to rotation of the shaft 33Q at a reduced torque.

Further, in the third embodiment, the second pitch part 333QB has a greater pitch than the second pitch part 333QD. This allows the first movable wall 34Q1 and the second movable wall 34Q2 to reach the toner discharge port 319Q almost simultaneously, the toner discharge port 319Q being disposed on the left of the middle of the container body 31Q in the left/right direction. In this manner, the thread pitches of the first thread portion 333Q1 and the second thread portion 333Q2 are set in accordance with the arrangement of the toner discharge port 319Q, thereby making it possible to adjust respective moving speeds and arrival times of the first movable wall 34Q1 and the second movable wall 34Q2 to the toner discharge port 319Q. Alternatively, it may be configured such that one of the first movable wall 34Q1 and the second movable wall 34Q2 reaches a position above the toner discharge port 319Q prior to the other, as described later.

Now, a toner container 30R (developer container) according to a fourth embodiment of the present disclosure will be described with reference to FIGS. 19 and 20.

Figure 19:
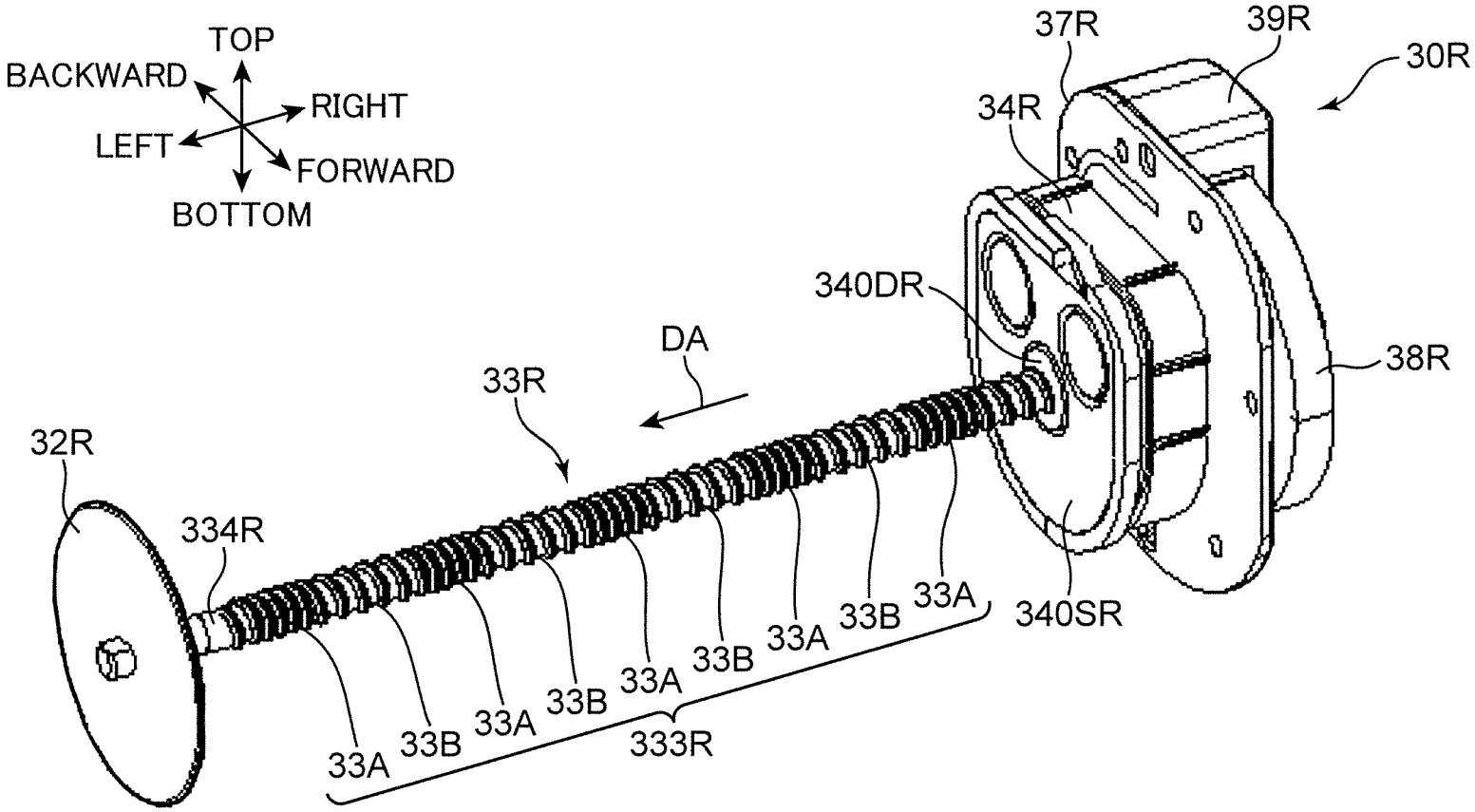
FIG. 19 is a perspective view showing the inside of a developer container according to a fourth embodiment of the present disclosure.

FIG. 19 is a perspective view showing the inside of the toner container 30R. A container body of the toner container 30R is not shown in FIG. 19. FIG. 20 is a front view of a shaft 33R of the toner container 30R. In these drawings, elements that have functions identical to those of the corresponding elements of the toner container 30 in the first embodiment are denoted by the same reference numerals as in the first embodiment, with R added at the end. The fourth embodiment differs from the toner container 30 of the first embodiment in the structure of the shaft 33R. Accordingly, description will be made mainly regarding the difference, and repeated description of other common features will be omitted. The toner container 30R includes the unillustrated container body, a stirring disc 32R, the shaft 33R, a movable wall 34R having a conveying surface 340SR, a lid 37R, a rotary gear 38R, and a cover 39R.

The shaft 33R includes a first shaft end portion 331R, a second shaft end portion 332R, a male thread portion 333 (first engaging portion), and a movable wall stopper portion 334R. On the other hand, a carrier bearing 340DR of the movable wall 34R includes an unillustrated female thread portion (second engaging portion) engageable with the male thread portion 333R. The stirring disc 32R is integrally rotated with the shaft 33R to stir toner in the toner container 30R.

Figure 20:
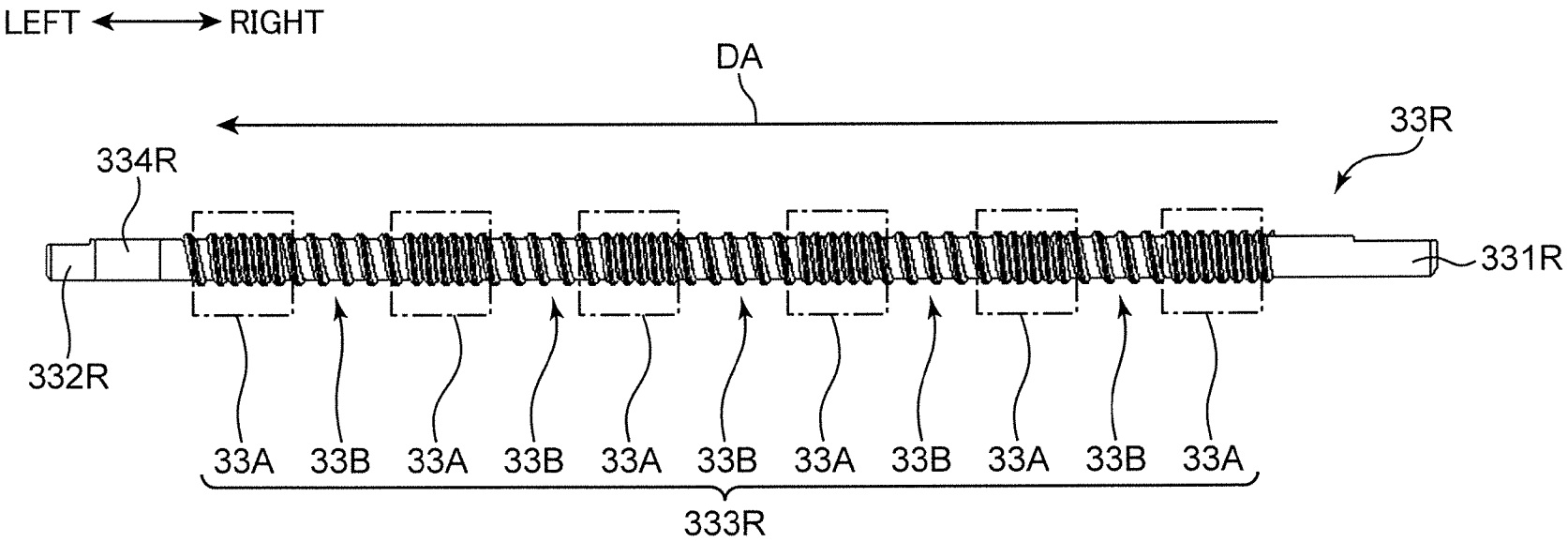
FIG. 20 is a front view of a shaft of the developer container according to the fourth embodiment of the present disclosure.

The male thread portion 333R includes first thread parts 33A (small pitch parts) and second thread parts 33B (FIGS. 19 and 20). The first thread part 33A is configured to have a pitch of about 1 mm in a first direction. On the other hand, the second thread part 33B is configured to have a pitch of about 2 mm in the first direction. In other words, the first thread part 33A has a smaller thread pitch than the second thread part 33B. In the fourth embodiment, the first thread parts 33A and the second thread parts 33B are disposed alternately as shown in FIG. 20. A rightmost one (a most upstream one in a moving direction of the movable wall 34R) of the first thread parts 33A bears an initial position of the movable wall 34R. This makes it possible to, when the movable wall 34R initially moves after the toner container 30R is mounted in the printer 100, stir tonner in a storage space of the toner container 30R by the stirring disc 32R while retarding the movement of the movable wall 34R. Consequently, the stirring of toner can be promoted and thereby a load put on the movable wall 34R for conveying the toner can be reduced at the first thread parts 33A. In particular, at the initial stage when a large amount of toner is stored in the storage space of the toner container 30R, it is possible to promote stirring of toner while retarding movement of the movable wall 34R. Therefore, aggregation of the toner and an increase in the rotational torque of the shaft 33R can be prevented at the initial stage. Further, because the movable wall 34R moves in the first direction slowly at the first thread parts 33A, it is possible to immediately stop the movement of the movable wall 34R when a toner sensor (not shown) detects the toner in the storage space.

When the toner is consumed from the storage space of the toner container 30R, the movable wall 34R finally comes to a final position in the same manner as shown in FIG. 12C. In the process, it is possible to actively stir the toner in the storage space by the stirring disc 32R during each time the movable wall 34R passes the first thread part 33A as shown in FIG. 20. Therefore, aggregation of the toner in the toner container 30R and an increase of the required torque for moving the movable wall 34R can be prevented until the end of use of the toner container 30R.

The toner container 30 (30P, 30Q, 30R), and the printer 100 including the same according to the embodiments of the present disclosure have been described. According to the above-described configurations, the male thread portion of the shaft includes the small pitch part to thereby make it possible to prevent the movable wall from excessively pressing toner. Consequently, the toner in the toner container can be prevented from aggregating. The present disclosure is not limited to the above-described embodiments and, for example, the following modified embodiments may be adopted.

(1) In the first embodiment, the printer 100 is illustrated as a monochrome printer. However, the present disclosure is not limited to this configuration. In particular, in the case where the printer 100 is provided as a tandem color printer, after the opening/closing cover 100C (FIG. 2) of the printer 100 is opened, toner containers 30 respectively corresponding to a plurality of colors may be mounted into the housing 101 from above so as to be adjacent to one another.

(2) In the first embodiment, the toner container 30 is mounted into the printer 100 in the longitudinal direction of the developing device 20. However, the present disclosure is not limited to this configuration. It may be configured such that the toner container 30 is mounted in a direction perpendicularly intersecting the longitudinal direction of the developing device 20.

(3) In the first embodiment, the toner container 30 includes the shutter 317. However, the present disclosure is not limited to this configuration. As described above, the movable wall 34 seals the toner discharge port 319 when it has reached the final position. Accordingly, a film seal may be disposed at the container body 31, the film seal for sealing the toner discharge port 319 from the outside until the toner container 30 begins to be used. When the toner container 30 is newly mounted in the printer 100, the film seal is peeled off by a user. Consequently, the toner discharge port 319 is opened to communicate with an unillustrated developing device. Thereafter, when toner in the toner container 30 has run out, the discharge port sealing part 341B of the movable wall 34 covers the toner discharge port 319, as described above. Further, in other modified embodiments, the movable wall 34 may stop at a position just before the toner discharge port 319 without covering the toner discharge port 319. Even in this case, toner existing near the movable wall 34 is discharged through the toner discharge port 319 by rotation of the stirring disc 32.

(4) The first embodiment employs the volume replenishment type toner supply method. However, the present disclosure is not limited to this method. An unillustrated toner sensor may be disposed in the developing device 20. When the toner sensor has detected that toner in the developing device 20 has decreased, the controller 50 causes the motor M to run to move the movable wall 34 in the first direction. This allows toner to fall through the toner discharge port 319 to flow into the developing device 20.

(5) In the first embodiment, the carrier bearing 340A is disposed in the central part of the movable wall 34. However, the present disclosure is not limited to this configuration. The carrier bearing 340A may be disposed in another area of the movable wall 34. It may be configured such that the carrier bearing 340A is disposed in an upper part of the movable wall 34, and the shaft 33 correspondingly extends in an upper part of the container body 31. In this case, pressure of toner that is exerted on the shaft seal 343 (FIG. 10A) is low. This allows the shaft seal 343 to maintain the sealing capability at a high level.

(6) In the first embodiment, the pitch of the male thread portion 333 gradually changes from the first pitch part 333A to the second pitch part 333B. However, the present disclosure is not limited to this configuration. The first pitch part 333A and the second pitch part 333B may be adjacent to each other in such a manner that the pitch of the male thread portion 333 abruptly changes from the first pitch part 333A to the second pitch part 333B. Further, another part having a relatively small thread pitch may be disposed between the second pitch part 333B and the toner discharge port in any one of the above-described embodiments.

(7) In the above-described second and third embodiments, the two movable walls reach the toner discharge port almost simultaneously. However, the present disclosure is not limited to this configuration. In the case where two movable walls are provided, they may be configured such that one movable wall reaches the toner discharge port first and waits for arrival of the other movable wall. In this case, a protrusion may be formed so as to extend radially outward from the shaft in order to stop the movable wall having reached the toner discharge port first.

(8) In each of the above-described embodiments, the stirring disc 32 (32P, 32Q, 32R) is in the form of a disc. According to this configuration, it is possible to have the storage space 31S almost disappear when the movable wall 34 has reached the final position. On the other hand, the present disclosure is not limited to this configuration. The stirring disc 32 may be formed with an unillustrated blade protruding toward the storage space 31S. In particular, if a plurality of blades are disposed in a circumferential direction of the stirring disc 32 at intervals, it is possible to efficiently stir toner in the storage space 31S. Alternatively, the stirring disc 32 may be in the form of a propeller.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A developer container, comprising:

a container body including an inner surface defining a cylindrical internal space extending in a first direction, and a wall disposed at one end of the container body in the first direction and defining an end surface of the internal space, the container body being formed with a developer discharge port formed in a lower portion of the container body and communicating with the internal space for discharging developer therethrough;

a lid attached to the other end of the container body that is opposite to the wall in the first direction for closing the internal space;

a shaft including a first engaging portion having a helical thread formed on an outer surface thereof, the shaft extending in the first direction in the internal space and rotatably supported on the wall and the lid;

a driving transmitter configured to transmit a rotational driving force to the shaft; and a movable wall including an outer surface disposed in close contact with the inner surface of the container body, a conveying surface defining a storage space configured to contain the developer in cooperation with the inner surface of the container body, and a carrier bearing including a second engaging portion protruding from an inner surface of the carrier bearing, the carrier bearing allowing the shaft to pass therethrough, the movable wall being movable along the shaft in the first direction in the internal space from an initial position remote from the developer discharge port to a predetermined position closer to the developer discharge port while conveying the developer in the storage space to the developer discharge port by engagement of the first engaging portion and the second engaging portion, wherein the first engaging portion includes a first pitch part having a thread pitch in the first direction and bearing the initial position of the movable wall and a second pitch part disposed downstream of the first pitch part in a moving direction of the movable wall and having a greater pitch than the first pitch part.

2. A developer container according to claim 1, wherein the first pitch part includes a subpart continuous to the second pitch part and having a thread pitch gradually increasing as advancing to the second pitch part.

3. A developer container according to claim 1, wherein:

the developer discharge port is located at one of the one end and the other end of the container body in the first direction.

4. A developer container according to claim 1, wherein the developer discharge port is disposed between the one end and the other end of the container body in the first direction, and the movable wall includes:

a first movable wall movable in the first direction from one of the one end and the other end of the container body to the developer discharge port; and a second movable wall movable in the first direction from the other of the one end and the other end of the container body to the developer discharge port.

5. A developer container according to claim 1, wherein the conveying surface of the movable wall is maintained in a vertical posture of perpendicularly intersecting the first direction by the engagement of the shaft and the carrier bearing maintains.

6. A developer container according to claim 1, further comprising:

a stirring member fixedly attached to the shaft and operable to integrally rotate with the shaft to thereby stir the developer in the storage space.

7. A developer container according to claim 6, wherein the first pitch part bears the initial position of the movable wall.

8. A developer container according to claim 6, wherein the stirring member is disposed near and above the developer discharge port.

9. A developer container according to claim 8, wherein the stirring member includes a disc disposed at the wall.

10. A developer container according to claim 1, wherein the shaft includes a movable wall stopper portion defined by a specific part of the shaft, the specific part being located above the developer discharge port and bearing no first engaging portion, the movable wall stopper portion being operable to stop the movable wall.

11. An image forming apparatus, comprising:

an apparatus body;

a developer container according to claim 1 detachably mounted in the apparatus body;

an image carrier having a surface configured to allow an electrostatic latent image to be formed thereon and operable to carry a developed image;

a developing device configured to receive the developer supplied from the developer container and supplying the developer to the image carrier; and a transfer section configured to transfer the developed image from the image carrier onto a sheet.

12. A developer container, comprising:

a container body including an inner surface defining a cylindrical internal space extending in a first direction, and a wall disposed at one end of the container body in the first direction and defining an end surface of the internal space, the container body being formed with a developer discharge port formed in a lower portion of the container body and communicating with the internal space for discharging developer therethrough;

a lid attached to the other end of the container body that is opposite to the wall in the first direction for closing the internal space;

a shaft including a first engaging portion having a helical thread formed on an outer surface thereof, the shaft extending in the first direction in the internal space and rotatably supported on the wall and the lid;

a driving transmitter configured to transmit a rotational driving force to the shaft;

a stirring member fixedly attached to the shaft and operable to integrally rotate with the shaft to thereby stir the developer in the storage space; and a movable wall including an outer surface disposed in close contact with the inner surface of the container body, a conveying surface defining a storage space configured to contain the developer in cooperation with the inner surface of the container body, and a carrier bearing including a second engaging portion protruding from an inner surface of the carrier bearing, the carrier bearing allowing the shaft to pass therethrough, the movable wall being movable along the shaft in the first direction in the internal space from an initial position remote from the developer discharge port to a predetermined position closer to the developer discharge port while conveying the developer in the storage space to the developer discharge port by engagement of the first engaging portion and the second engaging portion, wherein the first engaging portion includes a first pitch part having a thread pitch in the first direction another pitch part spaced from the first pitch part in the first direction.

13. A developer container, comprising:

a container body including an inner surface defining a cylindrical internal space extending in a first direction, and a wall disposed at one end of the container body in the first direction and defining an end surface of the internal space, the container body being formed with a developer discharge port formed in a lower portion of the container body and communicating with the internal space for discharging developer therethrough;

a lid attached to the other end of the container body that is opposite to the wall in the first direction for closing the internal space;

a shaft including a first engaging portion having a helical thread formed on an outer surface thereof, the shaft extending in the first direction in the internal space and rotatably supported on the wall and the lid;

a driving transmitter configured to transmit a rotational driving force to the shaft; and a movable wall including an outer surface disposed in close contact with the inner surface of the container body, a conveying surface defining a storage space configured to contain the developer in cooperation with the inner surface of the container body, and a carrier bearing including a second engaging portion protruding from an inner surface of the carrier bearing, the carrier bearing allowing the shaft to pass therethrough, the movable wall being movable along the shaft in the first direction in the internal space from an initial position remote from the developer discharge port to a predetermined position closer to the developer discharge port while conveying the developer in the storage space to the developer discharge port by engagement of the first engaging portion and the second engaging portion, wherein the first engaging portion includes a first pitch part having a thread pitch in the first direction, the outer surface of the movable wall includes a discharge port sealing portion operable to cover the developer discharge port, and when the movable wall is at the developer discharge port, the discharge port sealing portion covers the developer discharge port from an inside of the container body.

14. An image forming apparatus, comprising:

an apparatus body;

a developer container detachably mounted in the apparatus body, the developer including:

a container body including an inner surface defining a cylindrical internal space extending in a first direction, and a wall disposed at one end of the container body in the first direction and defining an end surface of the internal space, the container body being formed with a developer discharge port formed in a lower portion of the container body and communicating with the internal space for discharging developer therethrough;

a lid attached to the other end of the container body that is opposite to the wall in the first direction for closing the internal space;

a shaft including a first engaging portion having a helical thread formed on an outer surface thereof, the shaft extending in the first direction in the internal space and rotatably supported on the wall and the lid;

a driving transmitter configured to transmit a rotational driving force to the shaft; and a movable wall including an outer surface disposed in close contact with the inner surface of the container body, a conveying surface defining a storage space configured to contain the developer in cooperation with the inner surface of the container body, and a carrier bearing including a second engaging portion protruding from an inner surface of the carrier bearing, the carrier bearing allowing the shaft to pass therethrough, the movable wall being movable along the shaft in the first direction in the internal space from an initial position remote from the developer discharge port to a predetermined position closer to the developer discharge port while conveying the developer in the storage space to the developer discharge port by engagement of the first engaging portion and the second engaging portion, the first engaging portion includes a first pitch part having a thread pitch in the first direction;

an image carrier having a surface configured to allow an electrostatic latent image to be formed thereon and operable to carry a developed image;

a developing device configured to receive the developer supplied from the developer container and supplying the developer to the image carrier;

a transfer section configured to transfer the developed image from the image carrier onto a sheet;

a driving section connected to the driving transmitter and operable to generate a moving force for moving the movable wall; and a controller configured to control the driving section, wherein when the developer container is mounted in the apparatus body, the controller causes the movable wall to move in the first direction from the initial position for a predetermined duration.

15. An image forming apparatus according to claim 14, wherein:

the developer container includes a detection sensor provided on the container body near the developer discharge port and operable to detect the developer in the storage space, wherein when the developer container is mounted in the apparatus body, the controller causes the movable wall to move in the first direction from the initial position until the detection sensor detects the developer.

* * * * *